US010434803B2

(12) United States Patent
Oguchi et al.

(10) Patent No.: US 10,434,803 B2
(45) Date of Patent: Oct. 8, 2019

(54) SHEET CASSETTE AND PRINTING APPARATUS

(71) Applicant: FUJITSU COMPONENT LIMITED, Tokyo (JP)

(72) Inventors: Tatsuya Oguchi, Tokyo (JP); Sumio Watanabe, Tokyo (JP); Yukihiro Mori, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days.

(21) Appl. No.: 16/120,595

(22) Filed: Sep. 4, 2018

(65) Prior Publication Data

US 2019/0070872 A1 Mar. 7, 2019

(30) Foreign Application Priority Data

Sep. 7, 2017 (JP) ..... 2017-171887

(51) Int. Cl.

| | |
|---|---|
| ***B41J 15/04*** | (2006.01) |
| ***B41J 3/36*** | (2006.01) |
| ***B41J 13/10*** | (2006.01) |
| ***B65H 1/26*** | (2006.01) |
| ***B65H 3/44*** | (2006.01) |

(52) U.S. Cl.

CPC ..... *B41J 15/048* (2013.01); *B41J 3/36* (2013.01); *B41J 13/103* (2013.01); *B41J 15/044* (2013.01); *B65H 1/266* (2013.01); *B65H 3/44* (2013.01); *B65H 2402/46* (2013.01); *B65H 2403/51* (2013.01); *B65H 2405/113* (2013.01); *B65H 2405/313* (2013.01); *B65H 2405/332* (2013.01)

(58) Field of Classification Search

CPC . B41J 15/048; B41J 3/36; B41J 13/103; B41J 15/044; B65H 1/26; B65H 3/44

See application file for complete search history.

(56) References Cited

U.S. PATENT DOCUMENTS

| | | | | |
|---|---|---|---|---|
| 5,940,661 A * | 8/1999 | Yagi | G03G 15/0216 | 399/174 |
| 7,805,106 B2 * | 9/2010 | Kikuchi | G03G 15/6582 | 399/385 |
| 8,500,118 B2 * | 8/2013 | Shimmachi | B65H 3/0607 | 271/152 |

FOREIGN PATENT DOCUMENTS

| | | |
|---|---|---|
| AU | 2004201738 | 5/2004 |
| JP | 2004-345819 | 12/2004 |
| JP | 2006-159427 | 6/2006 |
| WO | 2007/097384 | 8/2007 |

* cited by examiner

*Primary Examiner* — Lamson D Nguyen
(74) *Attorney, Agent, or Firm* — IPUSA, PLLC

(57) ABSTRACT

A sheet cassette includes a housing, multiple cassettes stacked and provided in the housing, and a rotary cam. The cassettes store a recording sheet. The rotary cam includes multiple pins provided at opposite positions across the axis of rotation of the rotary cam. Adjacent cassettes are offset relative to each other in an offset direction. First receiving parts for receiving the pins are provided one in each of the adjacent cassettes at a first end thereof in the offset direction. The rotary cam rotates with at least one of the pins being in at least one of the first receiving parts of the adjacent cassettes to move the cassettes as connected.

6 Claims, 38 Drawing Sheets

SHEET CASSETTE AND PRINTING APPARATUS

CROSS-REFERENCE TO RELATED APPLICATION

The present application is based upon and claims priority to Japanese Patent Application No. 2017-171887, filed on Sep. 7, 2017, the entire contents of which are incorporated herein by reference.

BACKGROUND OF THE INVENTION

1. Field of the Invention

The present invention relates to sheet cassettes and printing apparatuses.

2. Description of the Related Art

Conventional portable printers are carried in a bag or the like. Such printers require recording sheets and a holder for storing recording sheets, which as well are often carried together with printers. Reference may be made to Japanese Laid-open Patent Publication Nos. 2006-159427 and 2004-345819 for related art.

SUMMARY OF THE INVENTION

According to an aspect of the present invention, a sheet cassette includes a housing, multiple cassettes stacked and provided in the housing, and a rotary cam. The cassettes store a recording sheet. The rotary cam includes multiple pins provided at opposite positions across the axis of rotation of the rotary cam. Adjacent cassettes are offset relative to each other in an offset direction. First receiving parts for receiving the pins are provided one in each of the adjacent cassettes at a first end thereof in the offset direction. The rotary cam rotates with at least one of the pins being in at least one of the first receiving parts of the adjacent cassettes to move the cassettes as connected.

DESCRIPTION OF THE EMBODIMENTS

Figure 1:
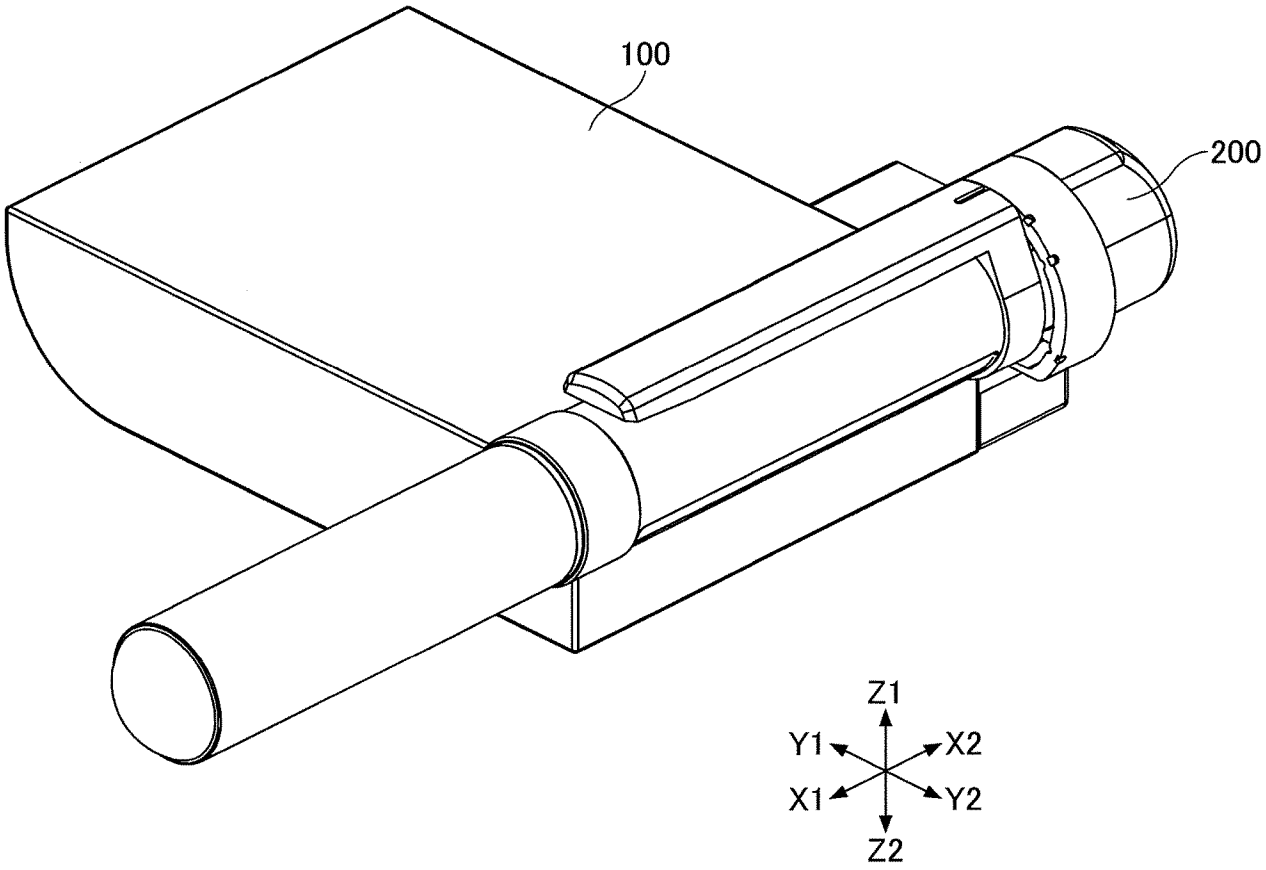
FIG. 1 is a perspective view of a printing apparatus according to a first embodiment.

In recent years, portable information terminals such as smartphones have been widely used, and it is desirable that printing be performed on a recording sheet using an information terminal just as using other types of information apparatuses. Because such information terminals are characterized by their portability, printing apparatuses are preferably small with high portability.

With the diversification of applications in information terminals, there is a demand for a sheet cassette that allows selecting a recording sheet from among different types of recording sheets and printing on the selected recording sheet.

According to an aspect of the present invention, a small, highly portable sheet cassette that allows selecting a desired recording sheet and printing on the selected recording sheet is provided.

Embodiments of the present invention are described below. In the following description, the same members or components are referred to using the same reference numeral, and a description thereof is not repeated. The embodiments are described using an XYZ coordinate system as defined as illustrated in the drawings. A direction along the X-axis is referred to as "X direction." A direction along the Y-axis is referred to as "Y direction." A direction along the Z-axis is referred to as "Z direction." The X direction, the Y direction, and the Z direction are orthogonal to one another.

First Embodiment

A printing apparatus according to a first embodiment is described with reference to FIG. 1. FIG. 1 is a perspective view of a printing apparatus according to this embodiment.

The printing apparatus is configured to receive information from an information terminal such as a smartphone by radio communication and perform printing based on the received information. The printing apparatus includes a sheet cassette 100 and a pen-type printer 200. The sheet cassette 100 includes multiple cassettes that can store multiple types of recording sheets that differ in size, thickness, color, etc.

Figure 2:
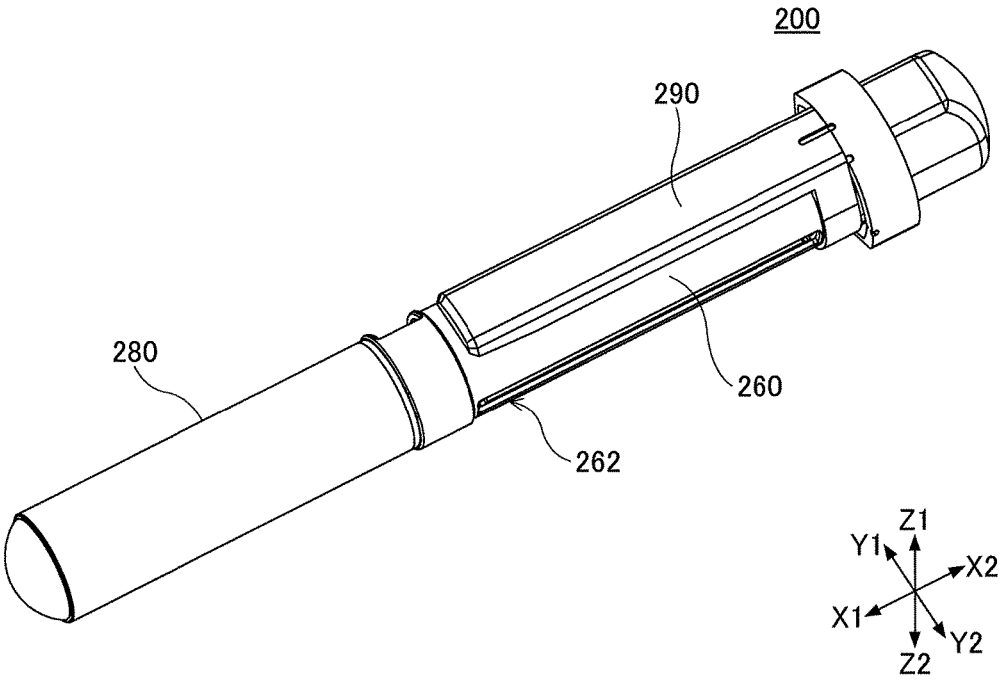
FIG. 2 is a perspective view of a printer according to the first embodiment.
Figure 3:
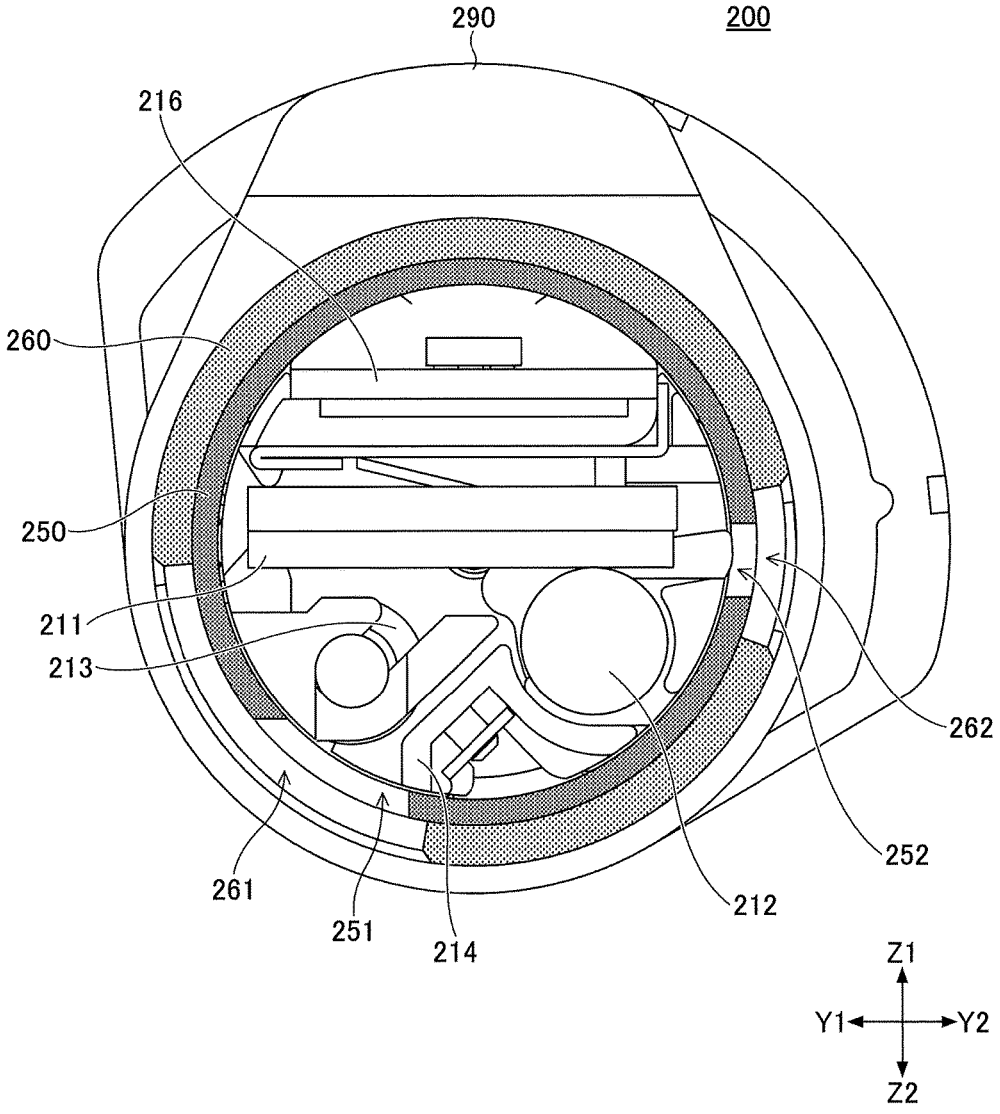
FIG. 3 is a cross-sectional view of a printer according to the first embodiment.

First, the printer 200 is described with reference to FIGS. 2 and 3. FIG. 2 is a perspective view of the printer 200. FIG. 3 is a partial cross-sectional view of the printer 200. The printer 200, which has a cylindrical appearance, is an Internet of Things (IoT) device with a printing function and a radio communication function.

The printer 200 includes a print head 211 such as a thermal head, a platen roller 212, a feed roller 213, a sheet guide 214, a spring, a control board 216, an inner cover 250, and an outer cover 260. The print head 211 is pressed against the platen roller 212 by the spring. A recording sheet is fed by the slightly adhesive feed roller 213 to move into the printer 200 along the sheet guide 214. The recording sheet is conveyed by the platen roller 212 while being held between the print head 211 and the platen roller 212, and is thereafter discharged. An electronic circuit and electronic components that control the printer 200 are mounted on the control board 216.

The inner cover 250 and the outer cover 260 are cylindrical, and the inner cover 250 is accommodated in the outer cover 260. The inner cover 250 includes an insertion opening 251 and a discharge opening 252 that are open along the generatrix of the inner cover 250. The outer cover 260 includes an insertion opening 261 and a discharge opening 262 that are open along the generatrix of the outer cover 260. The outer cover 260 is rotatable relative to the inner cover 250. When the printer 200 performs printing, the opening 251 and the opening 261 are aligned to be open, and the opening 252 and the opening 262 are aligned to be open. A recording sheet enters the printer 200 through the openings 251 and 261, and is discharged through the openings 252 and 262.

The sheet cassette 100 can be connected to the opening 261 with the openings 251 and 261 being open to allow printing to be performed. Print data are transmitted from an information terminal to the printer 200 through radio communication using, for example, Bluetooth Low Energy (BLE). The printer 200 receives the print data and performs printing on a recording sheet.

A power supply 280 storing a lithium-ion battery, which is a rechargeable battery, is provided in the housing of the printer 200. The printer 200 can be driven with electric power supplied from the lithium-ion battery.

The printer 200, which is approximately 18 mm in diameter and approximately 165 mm to approximately 170 mm in length, is small and can be carried around without stress. The printer 200 includes a hook 290 which allows the printer 200 to be put in the chest pocket of clothes just like a pen to be carried around.

Figure 4:
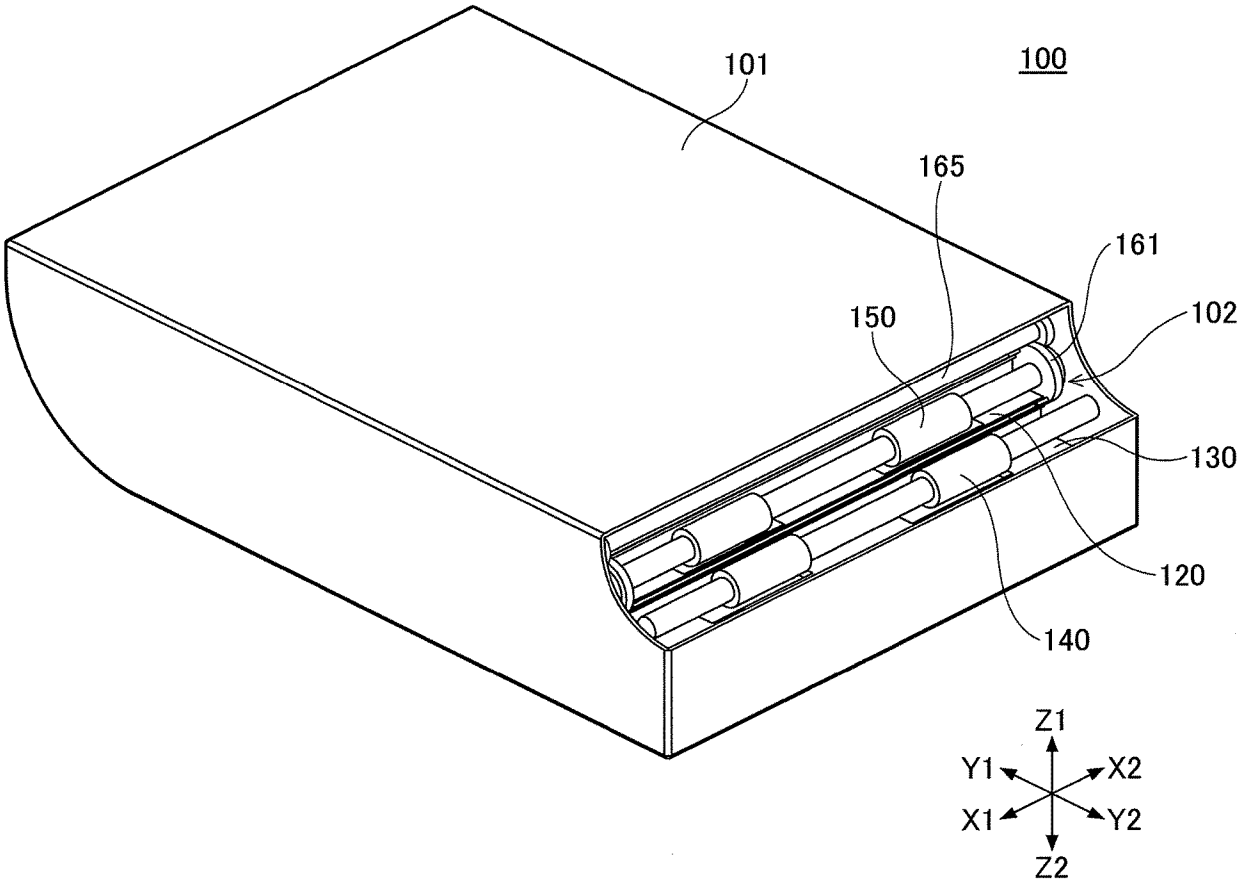
FIG. 4 is a perspective view of a sheet cassette according to the first embodiment.
Figure 5:
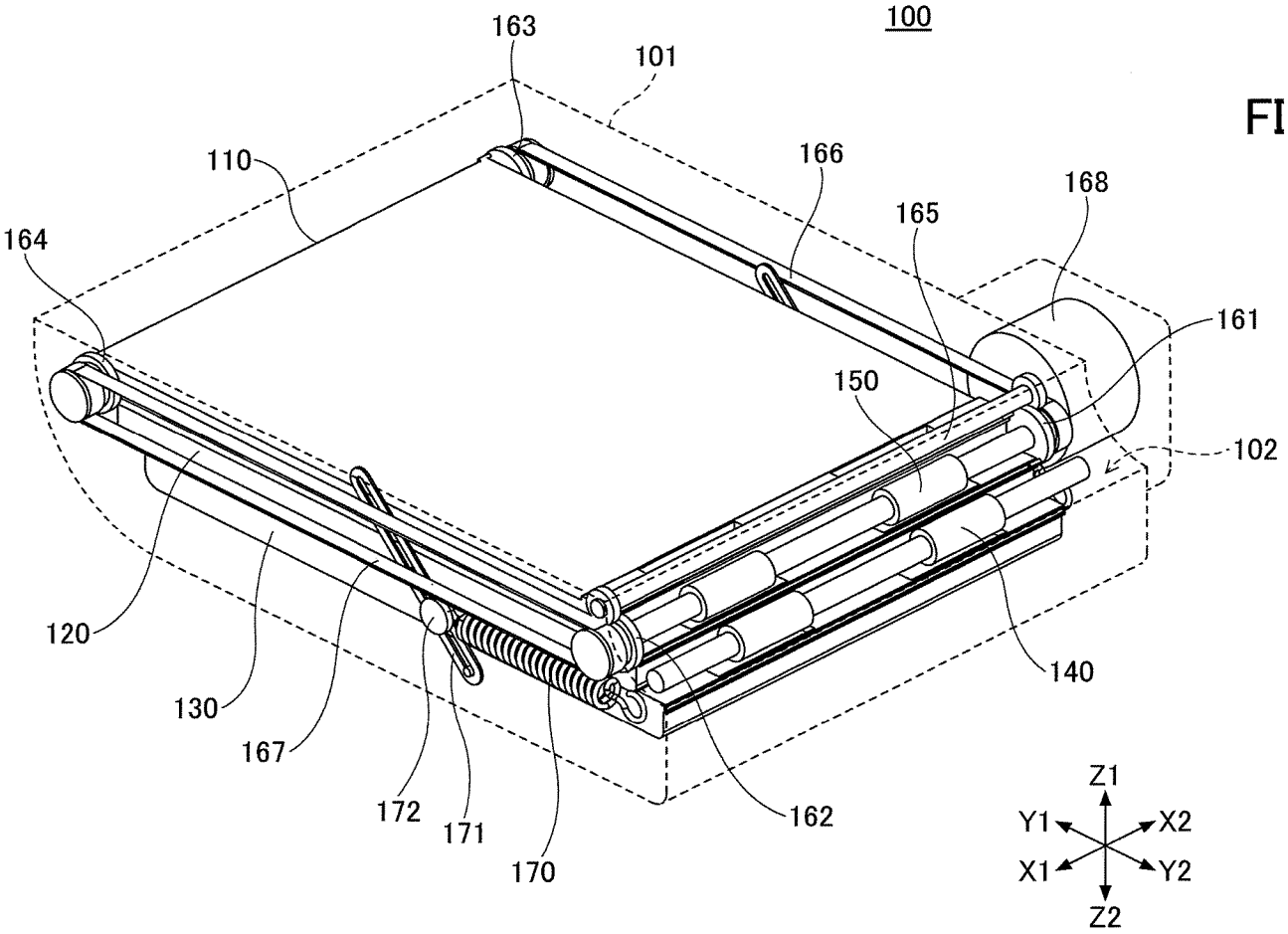
FIG. 5 is a perspective view of the sheet cassette according to the first embodiment.
Figure 6:
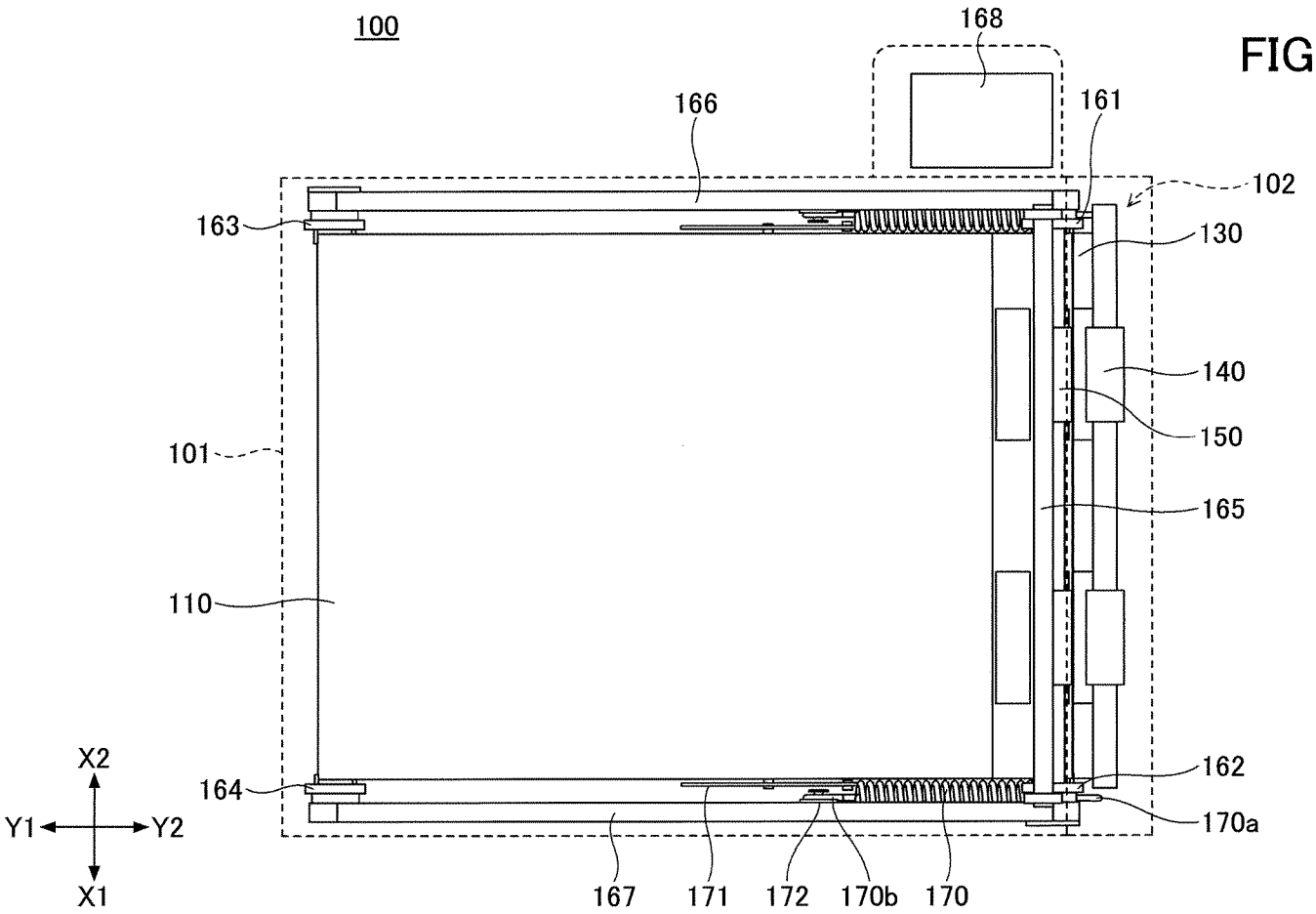
FIG. 6 is a plan view of the inside of the sheet cassette according to the first embodiment.
Figure 10:
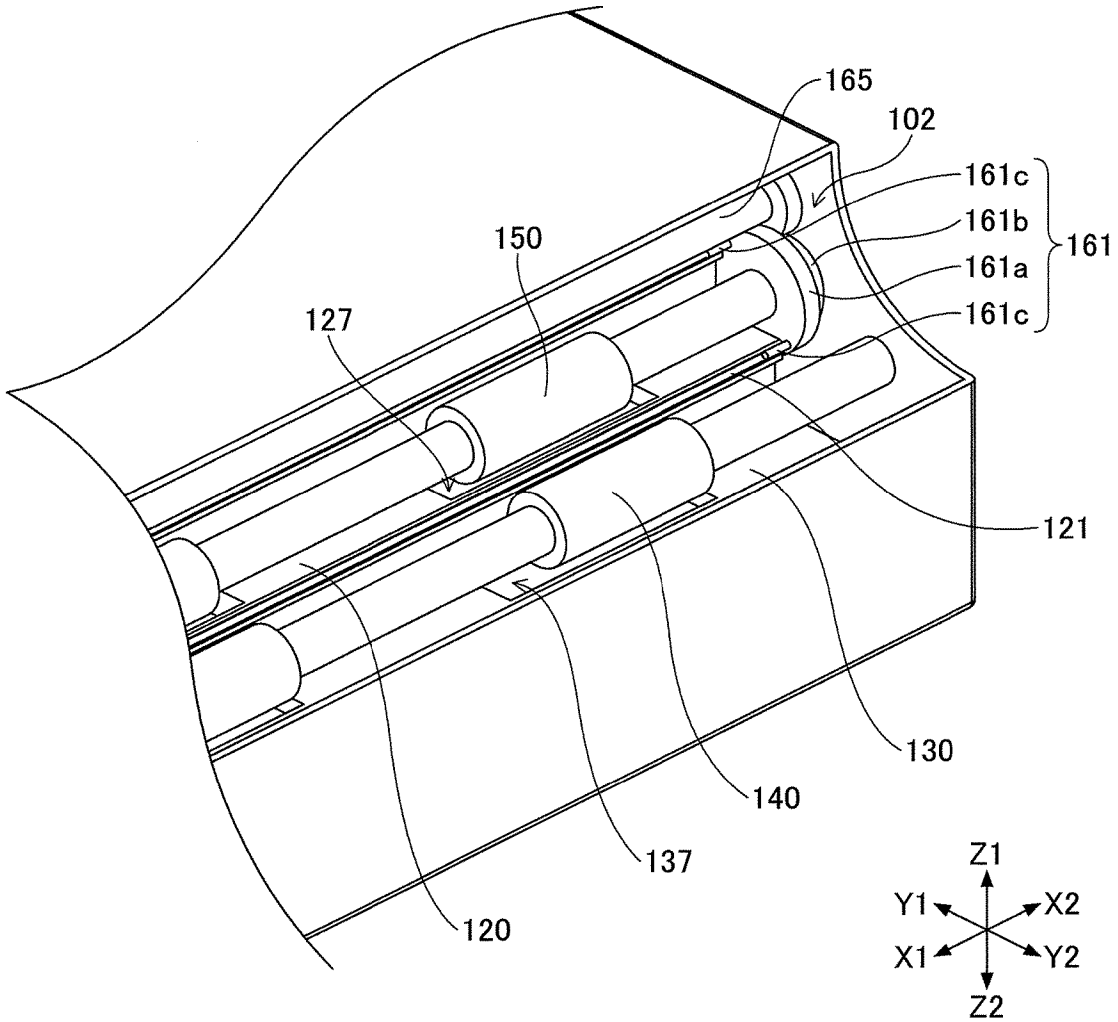
FIG. 10 is a perspective view of part of the sheet cassette according to the first embodiment.

Next, the sheet cassette 100 is described. FIG. 4 is a perspective view of the sheet cassette 100. FIG. 5 is a perspective phantom view of the sheet cassette 100, illustrating the inside of the sheet cassette 100. FIGS. 6, 7, 8 and 9 are a plan view, a left side view, a right side view and a front view, respectively, of the sheet cassette 100. FIG. 10 is an enlarged view of part of FIG. 4.

The sheet cassette 100 is longer in the Y direction than in the X direction to be substantially rectangular. The sheet cassette 100 includes a first cassette 110, a second cassette 120, a third cassette 130, a first roller 140, and a second roller 150 in a housing 101 of the sheet cassette 100. The first cassette 110, the second cassette 120, and the third cassette 130 can store different types of recording sheets. The size of recording sheets used in this embodiment is, for example, A8 (52 mm×74 mm).

The first roller 140 and the second roller 150 are for conveying a recording sheet, and are elongated in the X direction. An opening 102 for feeding a recording sheet to a printer is formed in the housing 101 near the first roller 140 and the second roller 150.

The sheet cassette 100 further includes rotary transfer cams ("cams") 161, 162, 163 and 164 in the housing 101. Referring to FIG. 10, the cam 161 includes a first disk 161*a*, a second disk 161*b*, and two pins 161*c*. The second disk 161*b* is smaller in diameter than and is on the outer side of the first disk 161*a*. The two pins 161*c* are provided on the inside surface of the first disk 161*a*. The circle of the first disk 161*a* is concentric with the circle of the second disk 161*b*. The pins 161*c* are provided at opposite positions across the center of the circle, namely, the axis of rotation, of the first disk 161*a*. That is, the midpoint between the pins 161*c* is the center of the first disk 161*a*, and the pins 161*c* are formed at positions rotationally 180° apart around the center of the first disk 161*a*. The other cams 162, 163 and 164 are formed into the same shape as the cam 161.

The cams 161 and 162 are provided at the X2-side end and the X1-side end, respectively, of the shaft of the second roller 150. The cams 161 and 162 are at the Y2-side end of the sheet cassette 100. According to this embodiment, while the center of the shaft of the second roller 150 coincides with the center of the cams 161 and 162, the second roller 150 and the cams 161 and 162 are connected to rotate independent of each other. The rotation of the cam 161 is transmitted to the cam 162 by a transmission shaft 165. A gear provided on the cam 161 meshes with a gear provided on the transmission shaft 165, and another gear provided on the transmission shaft 165 meshes with a gear provided on the cam 162. Accordingly, when the cam 161 rotates, the transmission shaft 165 rotates, so that the cam 162 rotates.

The cams 163 and 164 are provided at the Y1-side end of the sheet cassette 100, and are on the X2 side and the X1 side, respectively. Furthermore, a timing belt 166 that transmits the rotation of the cam 161 to the cam 163 and a timing belt 167 that transmits the rotation of the cam 162 to the cam 164 are provided on the X2 side and the X1 side, respectively, of the sheet cassette 100. In addition, a motor 168 for rotating the cam 161 is provided in the sheet cassette 100.

According to this embodiment, the motor 168 rotates the cam 161, so that this rotation is transmitted to the cam 162 via the transmission shaft 165 to rotate the cam 162. At the same time, the rotation of the cam 161 is transmitted to the cam 163 via the timing belt 166 to rotate the cam 163, and the rotation of the cam 162 is transmitted to the cam 164 via the timing belt 167 to rotate the cam 164. Accordingly, by rotating the cam 161 with the motor 168, the cams 162, 163 and 164 rotate in conjunction with the cam 161 via the transmission shaft 165 and the timing belts 166 and 167.

Figure 7:
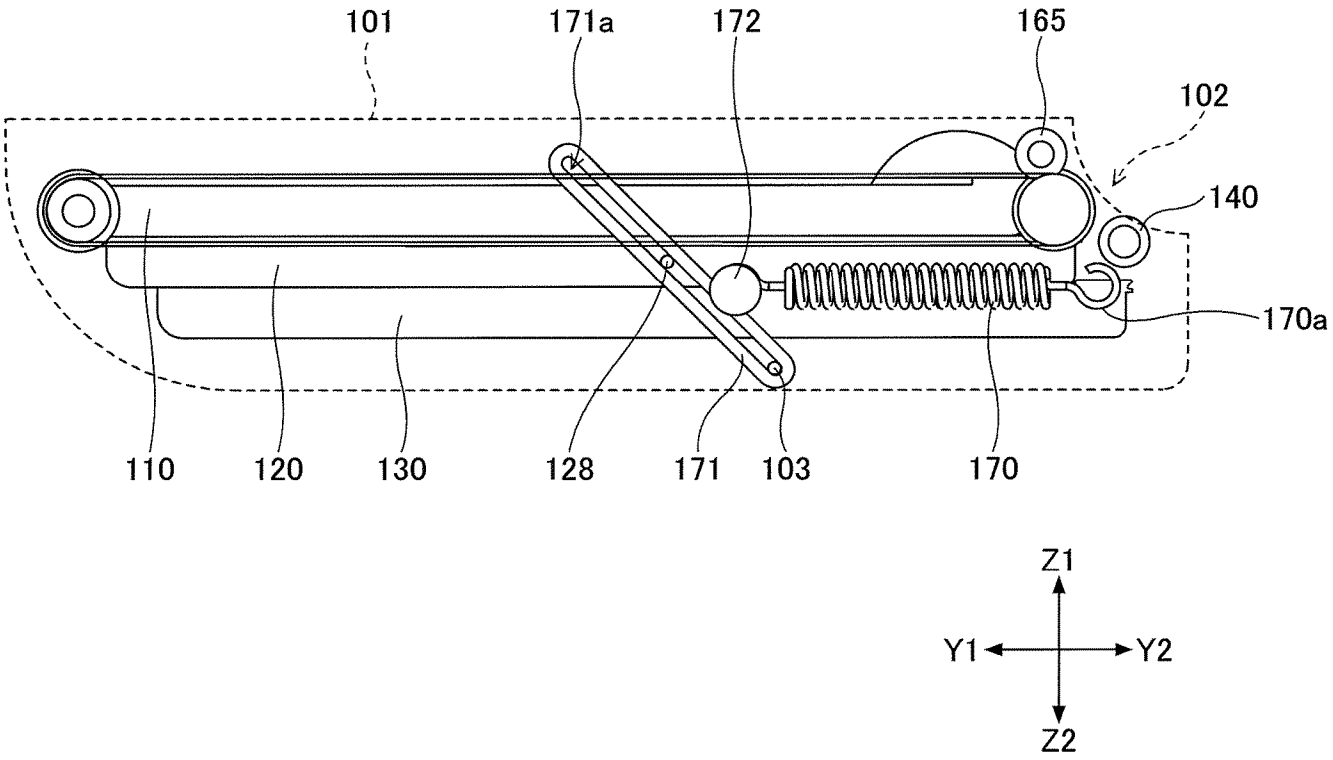
FIG. 7 is a left side view of the inside of the sheet cassette according to the first embodiment.
Figure 8:
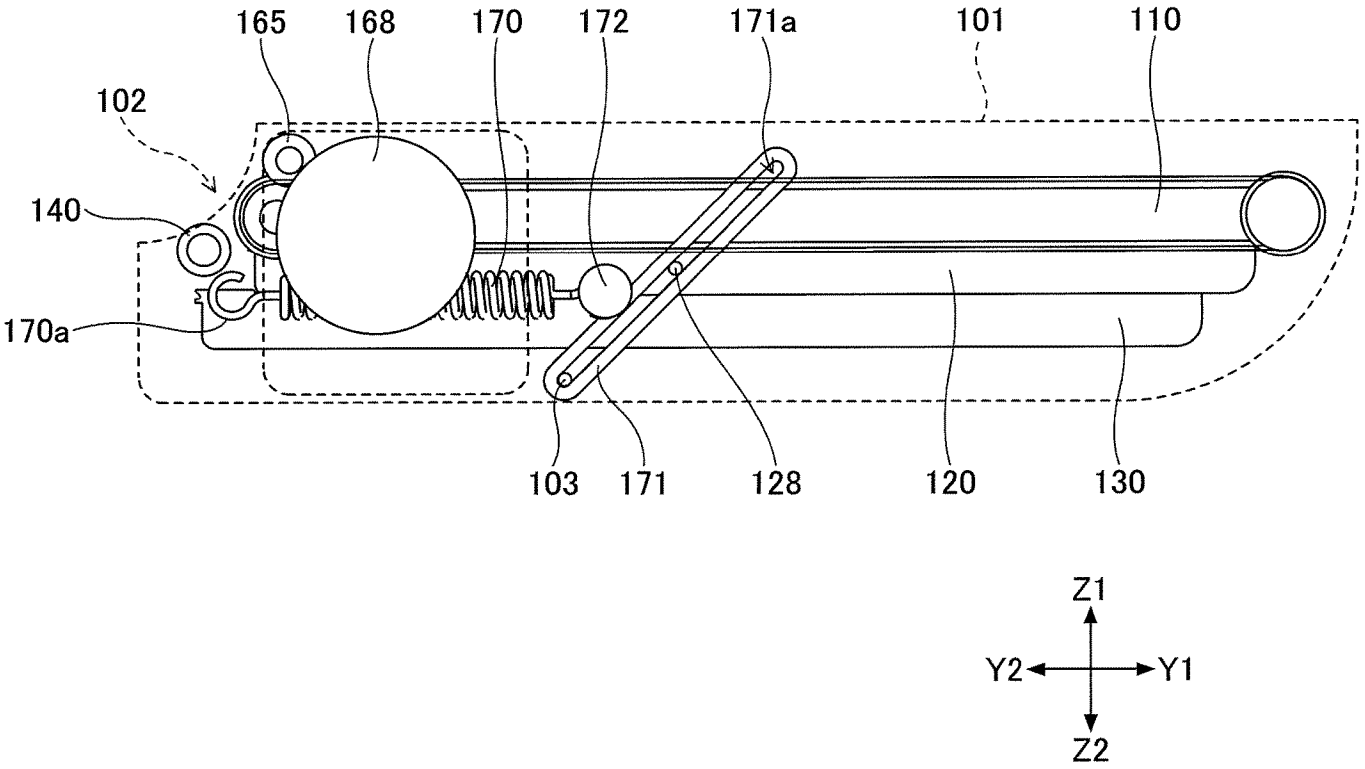
FIG. 8 is a right side view of the inside of the sheet cassette according to the first embodiment.
Figure 9:
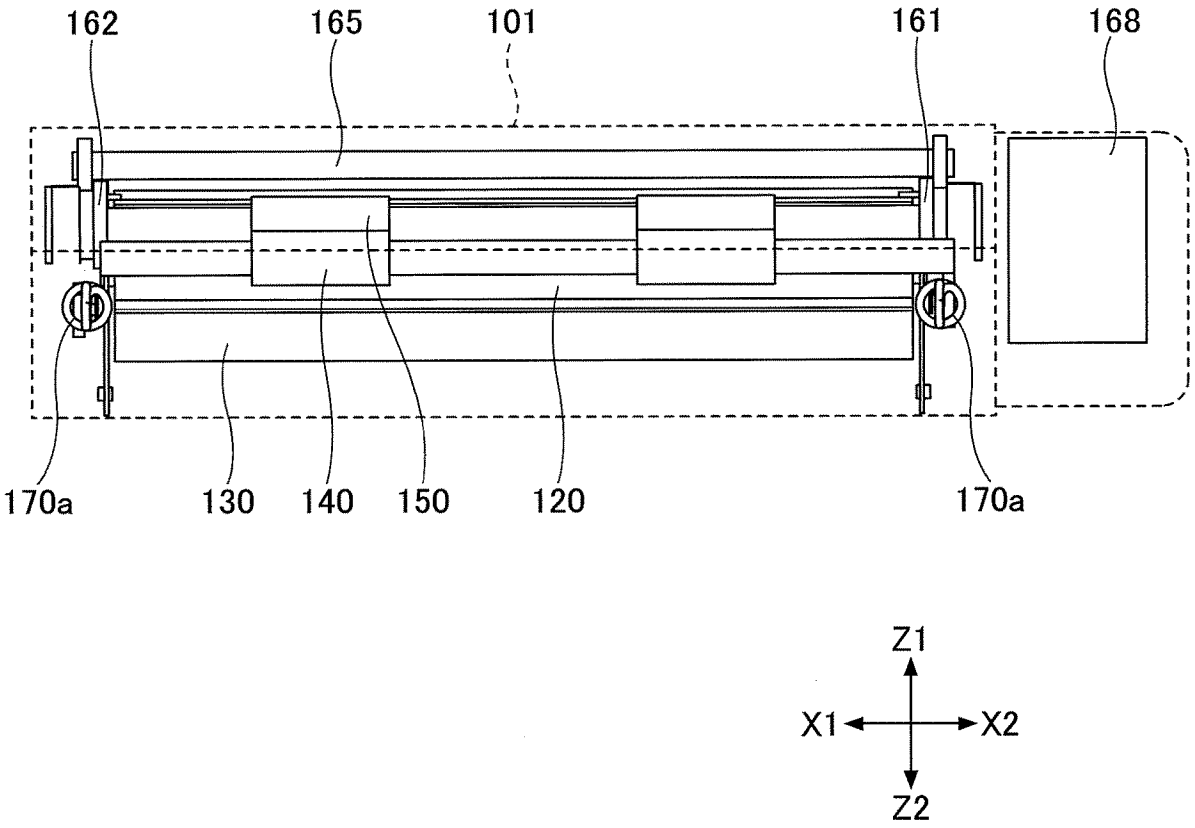
FIG. 9 is a front view of the inside of the sheet cassette according to the first embodiment.

According to this embodiment, as illustrated in FIGS. 7 and 8, support pins 128 are provided one on each side surface of the second cassette 120. Springs 170 are provided one on each of the X1 side and the X2 side and connecting members 171 are provided one on each of the X1 side and the X2 side of the first cassette 110, the second cassette 120, and the third cassette 130. The springs 170 are coil springs for example, and have respective first ends 170*a* connected to the inside of the housing 101 and respective second ends 170*b* connected to connection parts 172 provided one on each connecting member 171. In each connecting member 171, an elongated hole 171*a* is formed, and the support pin 128 and a support pin 103 are in the elongated hole 171*a*. In this state, a restoring force is exerted on each spring 170 in a compressing direction, namely, in a direction to move each connecting member 171 in the Y2 direction.

Figure 11:
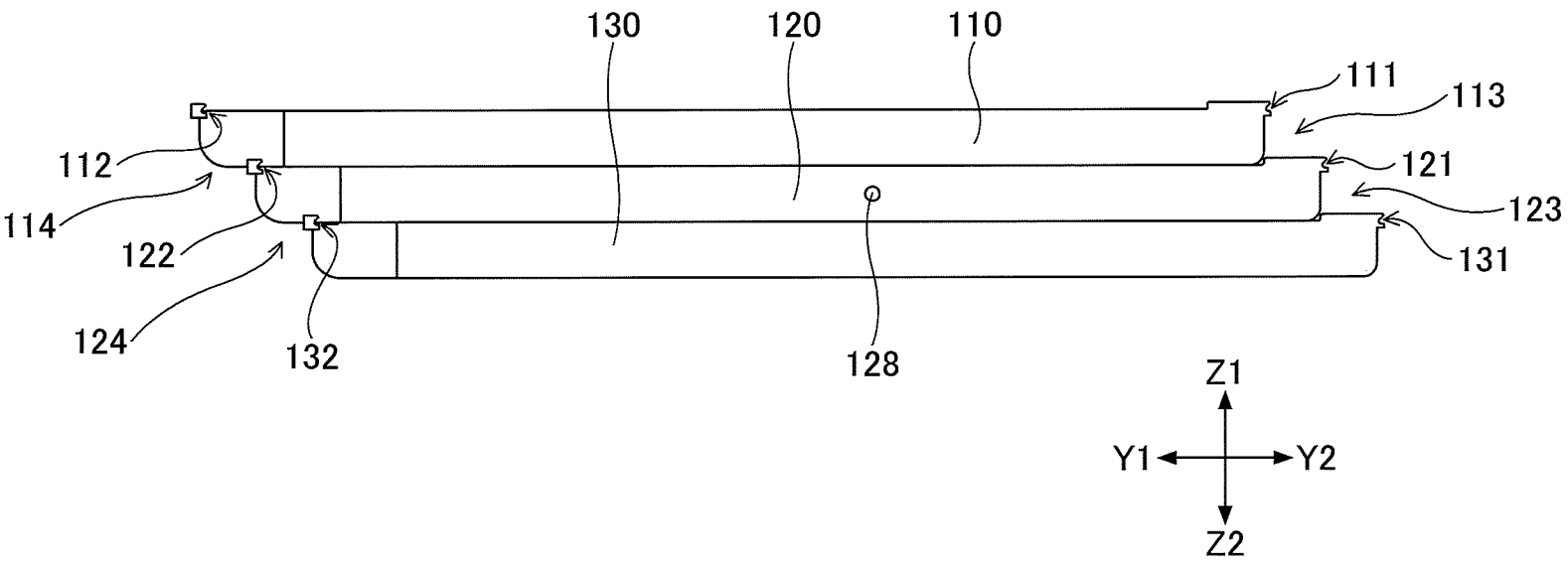
FIGS. 11 through 13 are diagrams illustrating a first cassette, a second cassette, and a third cassette.
Figure 12:
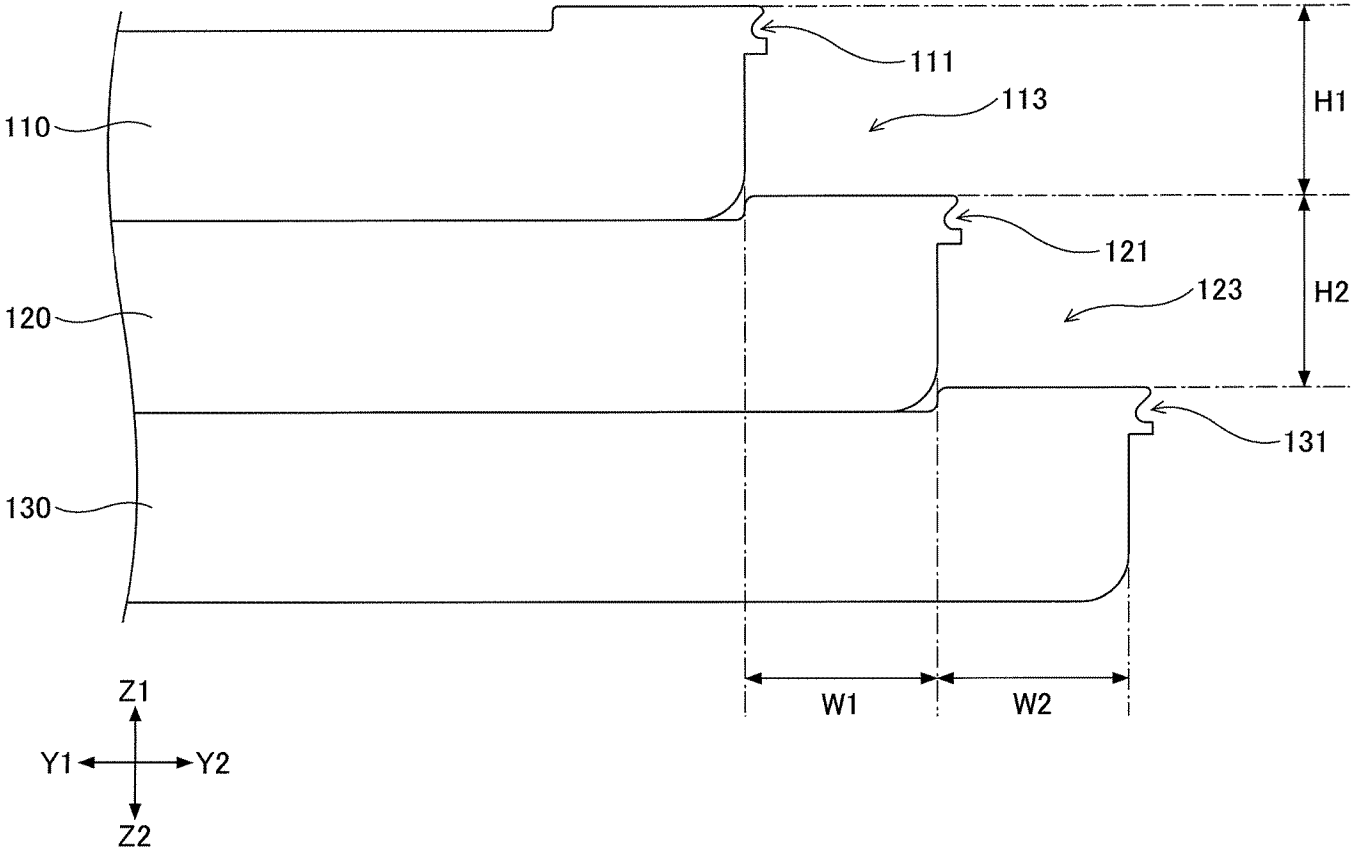
Figure 13:
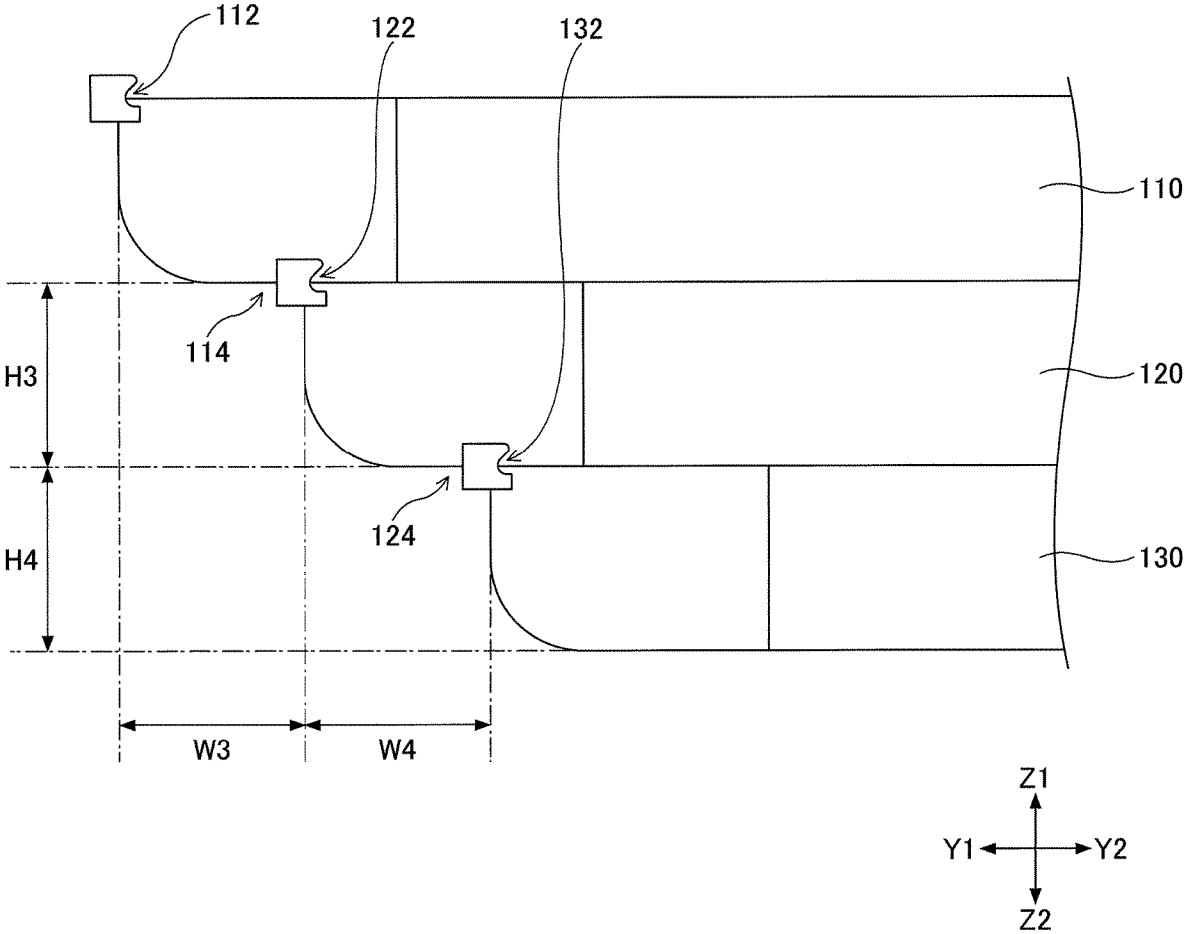

According to this embodiment, as illustrated in FIGS. 11 through 13, the first cassette 110, the second cassette 120, and the third cassette 130 are connected, being stacked in the Z direction in the housing 101. FIGS. 11, 12 and 13 are a side view, a Y2-end side view, and a Y1-end side view, respectively, of the stacked cassettes 110 through 130.

According to this embodiment, each of the first cassette 110, the second cassette 120, and the third cassette 130 includes a connecting part for connecting to the other cassettes. By connecting their respective connecting parts, the first cassette 110, the second cassette 120, and the third cassette 130 can be integrated.

When the first cassette 110, the second cassette 120, and the third cassette 130 are stacked and connected, the first cassette 110 is offset in the Y1 direction relative to the second cassette 120 to form a step 113 at their Y2-side end and a step 114 at their Y1-side end, and the second cassette 120 is offset in the Y1 direction relative to the third cassette 130 to form a step 123 at their Y2-side end and a step 124 at their Y1-side end.

According to this embodiment, as illustrated in FIG. 12, a height H1 and a width W1 of the step 113 are substantially equal, and a height H2 and a width W2 of the step 123 are substantially equal. Likewise, as illustrated in FIG. 13, a height H3 and a width W3 of the step 114 are substantially equal, and a height H4 and a width W4 of the step 124 are substantially equal.

To sequentially switch the cassettes 110 through 130, a rotating shaft is necessary. It is most efficient to use the rotating shaft of the second roller 150 as such a rotating shaft.

The topmost recording sheet stored in each of the cassettes has to contact the second roller 150. Therefore, one of the pins 161*c* has to be positioned above a plane contacting the second roller 150, and the second roller 150 has to be positioned within an arc drawn by the pins 161*c*. If the rotating shaft were separately provided, the rotating shaft would always have to be positioned outside the second roller 150. However, the end face of the cassette positioned on the Y1 side of the second roller 150 cannot interfere with the second roller 150, either. At the same time, the distance between the center of the rotating shaft and the receiving part of the cassette positioned on the Y1 side of the second roller 150 has to be equal to the distance between the center of the rotating shaft and the receiving part of the cassette contacting the second roller 150. Therefore, an arrangement that meets these three conditions increases in width and height compared with the arrangement that employs the second roller 150 as a rotation center. Accordingly, it is most efficient to use the rotating shaft of the second roller 150 as a rotating shaft for transferring the cassettes.

A receiving part 111 and a receiving part 112 are provided at the Y2-side upper end and the Y1-side upper end, respectively, of the first cassette 110. A receiving part 121 and a receiving part 122 are provided at the Y2-side upper end and the Y1-side upper end, respectively, of the second cassette 120. A receiving part 131 and a receiving part 132 are provided at the Y2-side upper end and the Y1-side upper end, respectively, of the third cassette 130.

Each of the cassettes 110 through 130 includes a window for causing the second roller 150 to contact the stored recording sheet. FIG. 10 depicts a window 127 provided in the second cassette 120 and a window 137 provided in the third cassette 130 in a state that the second roller 150 is in contact with the recording sheet stored in the second cassette 120 through the window 127.

Next, selecting a recording sheet in the sheet cassette 100 is described. A recording sheet is selected by rotating the motor 168.

Figure 14:
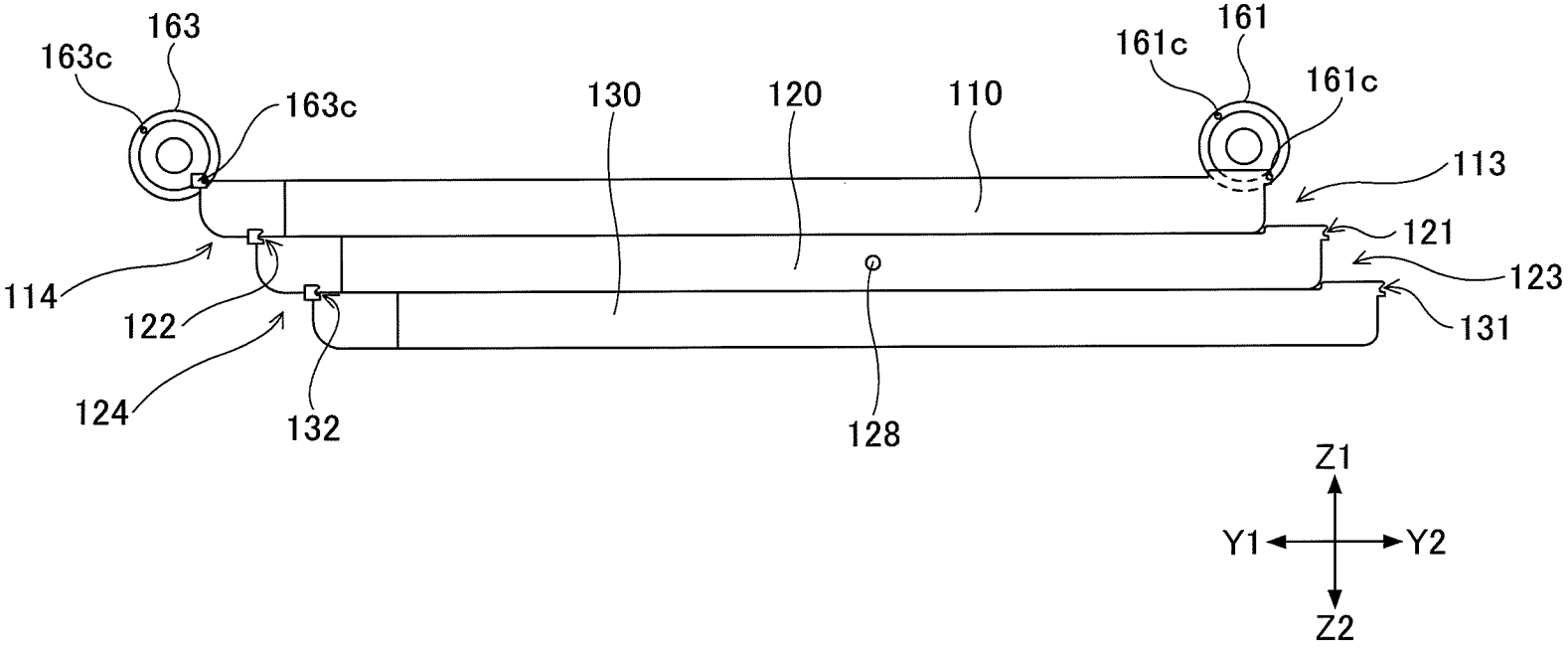
FIGS. 14 through 17 are diagrams illustrating that the first cassette is selected.
Figure 15:
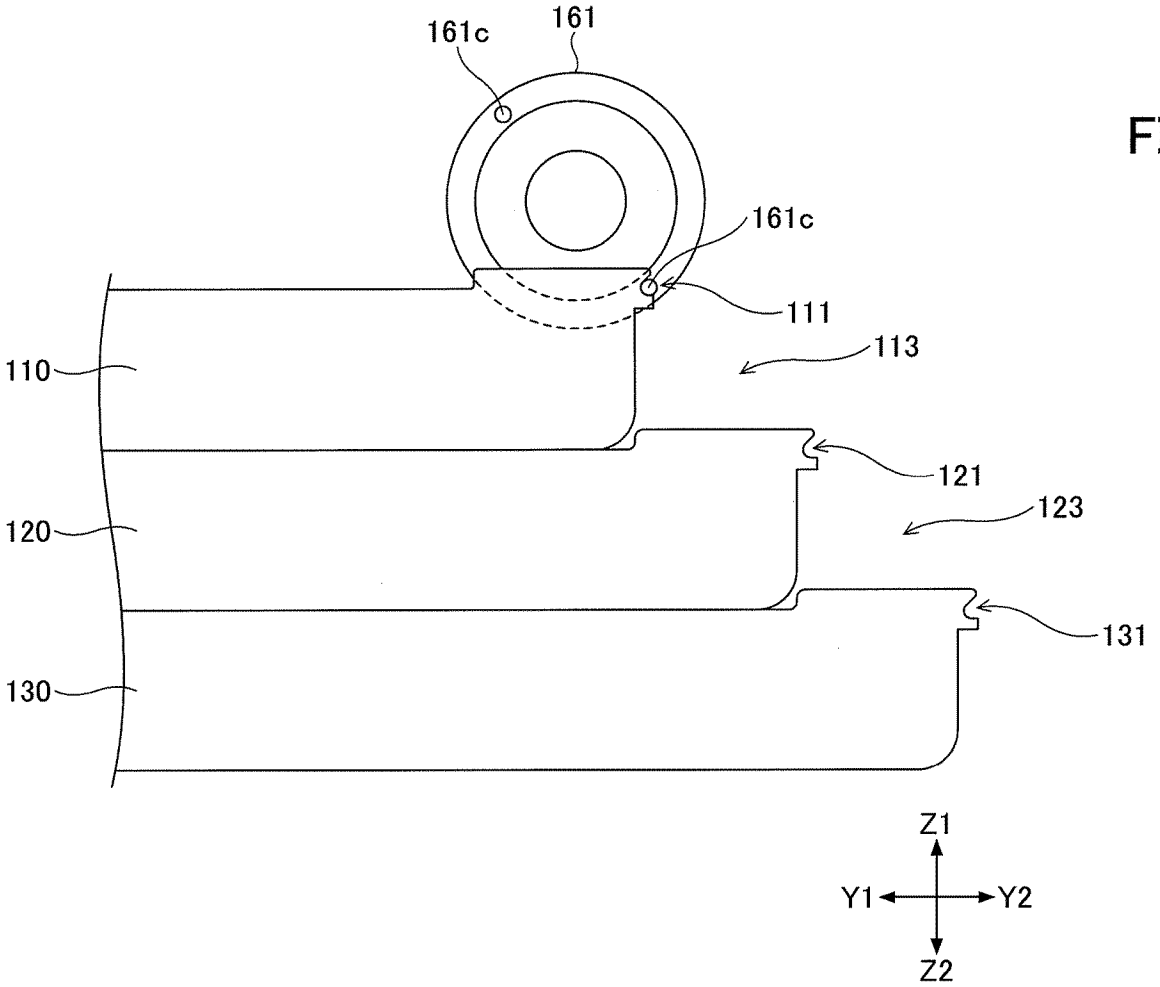
Figure 16:
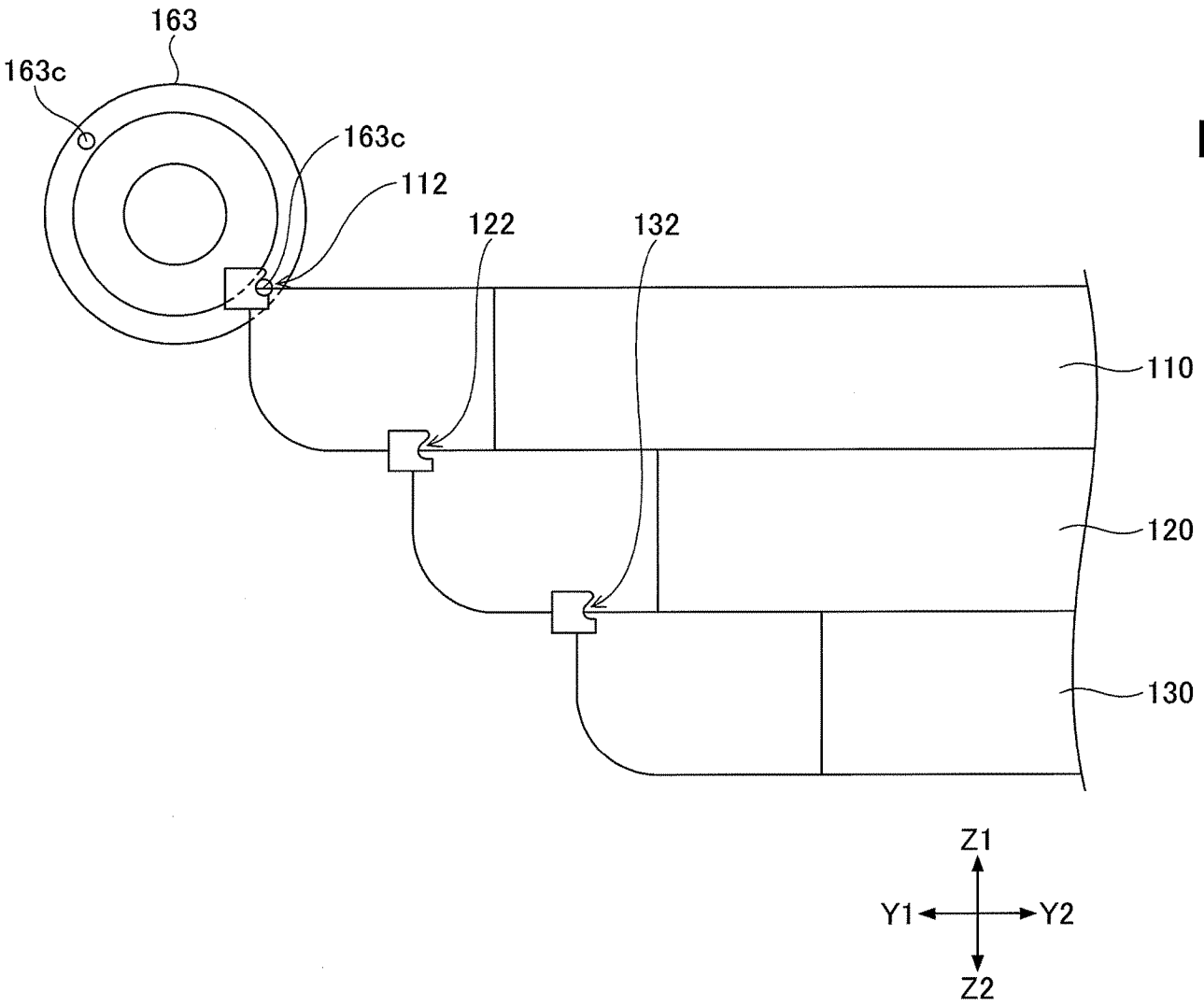
Figure 17:
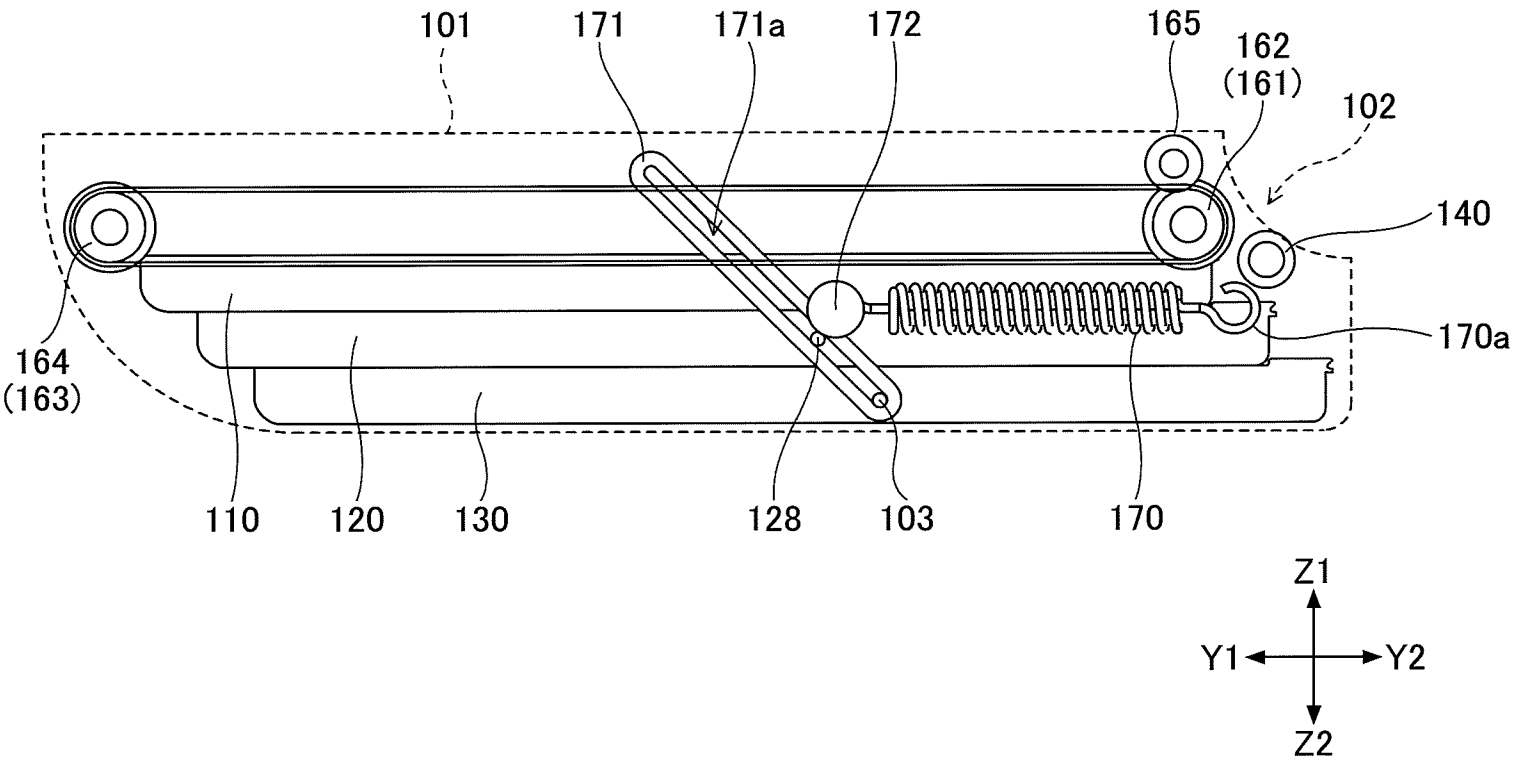
Figure 21:
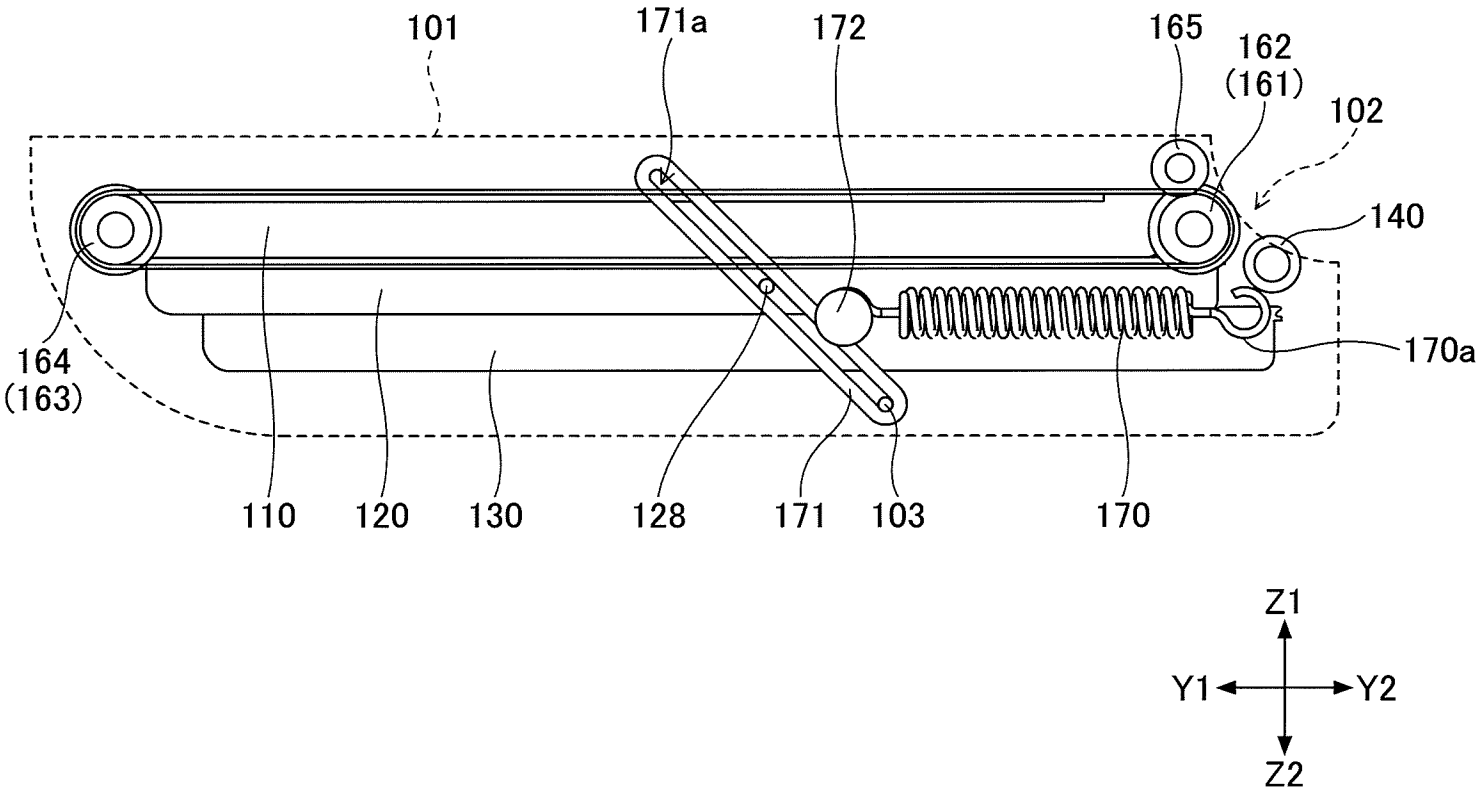
Figure 26:
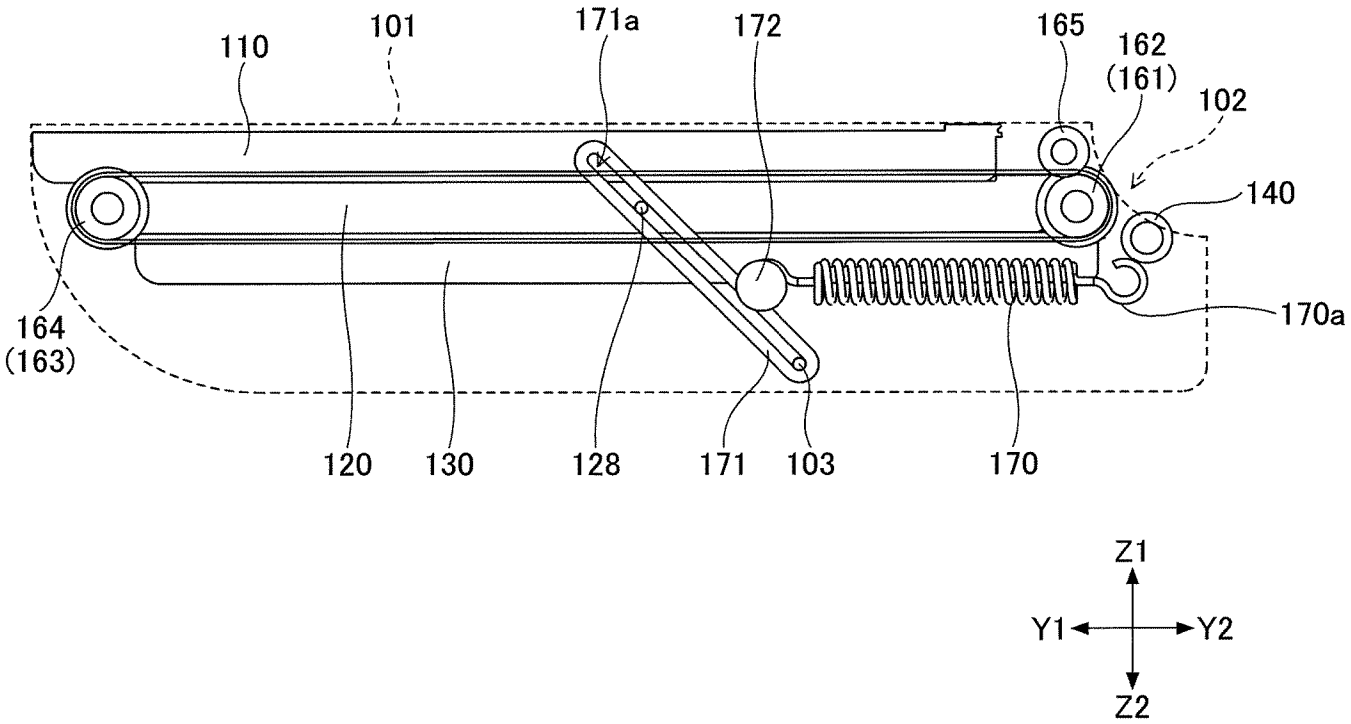

FIGS. 14 through 17 illustrate the case of performing printing on a recording sheet stored in the first cassette 110. FIGS. 14, 15 and 16 are a side view, a Y2-end enlarged side view, and a Y1-end enlarged side view, respectively, of the stacked cassettes 110 through 130. FIG. 17 illustrates the cassettes 110 through 130 in the housing 101 with one of the springs 170 and one of the connecting members 171 being depicted. While only the cams 162 and 164 are depicted in FIGS. 17, 21 and 26, the cams 161 and 163 are provided at corresponding positions on the other side of the illustrated structure.

As described above, the two pins 161*c* are provided at opposite positions on the cam 161. Likewise, two pins 163*c* are provided at opposite positions on the cam 163. When the first cassette 110 is selected, one of the pins 161*c* is in the receiving part 111 of the first cassette 110, and one of the pins 163*c* is in the receiving part 112 of the first cassette 110. The other of the pins 161*c* and the other of the pins 163*c* are in contact with nothing. The pin 161*c* in the receiving part 111 in the state of FIG. 15 shall be referred to as "first pin 161*c*," and the other pin 161*c* in contact with nothing in the state of FIG. 15 shall be referred to as "second pin 161*c*." The pin 163*c* in the receiving part 112 in the state of FIG. 16 shall be referred to as "first pin 163*c*," and the other pin 163*c* in contact with nothing in the state of FIG. 16 shall be referred to as "second pin 163*c*."

Furthermore, a clockwise urging force is exerted on the connecting member 171 around the support pin 103 by the spring 170 in the state illustrated in FIG. 17. The support pin 128 in the elongated hole 171*a* is pressed in the Y2 direction by this urging force. When the support pin 128 is thus pressed in the Y2 direction, the whole of the cassettes 110 through 130 is pressed in the Y2 direction to prevent separation of the receiving part 111 and the first pin 161*c*. The second roller 150 is in contact with the topmost recording sheet stored in the first cassette 110.

Figure 18:
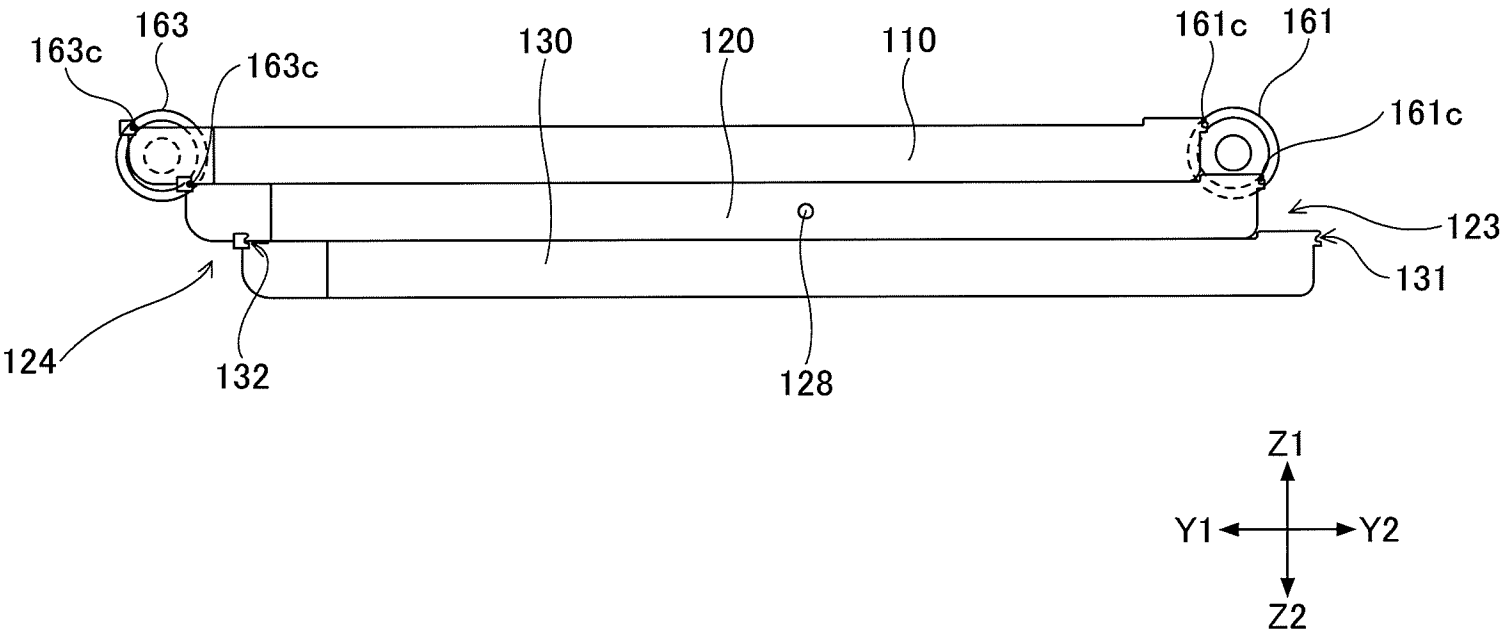
FIGS. 18 through 21 are diagrams illustrating that the second cassette is selected.
Figure 19:
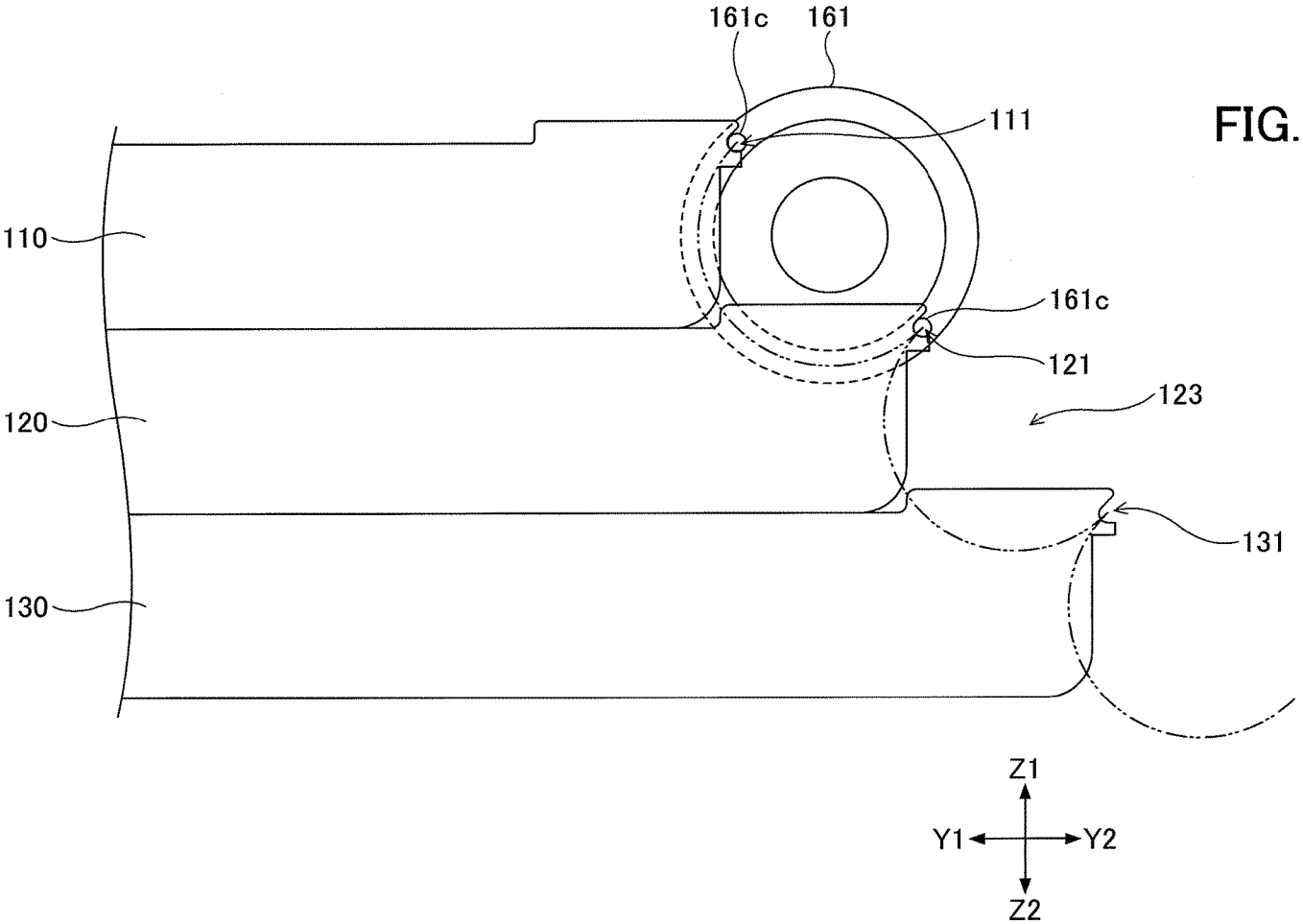
Figure 20:
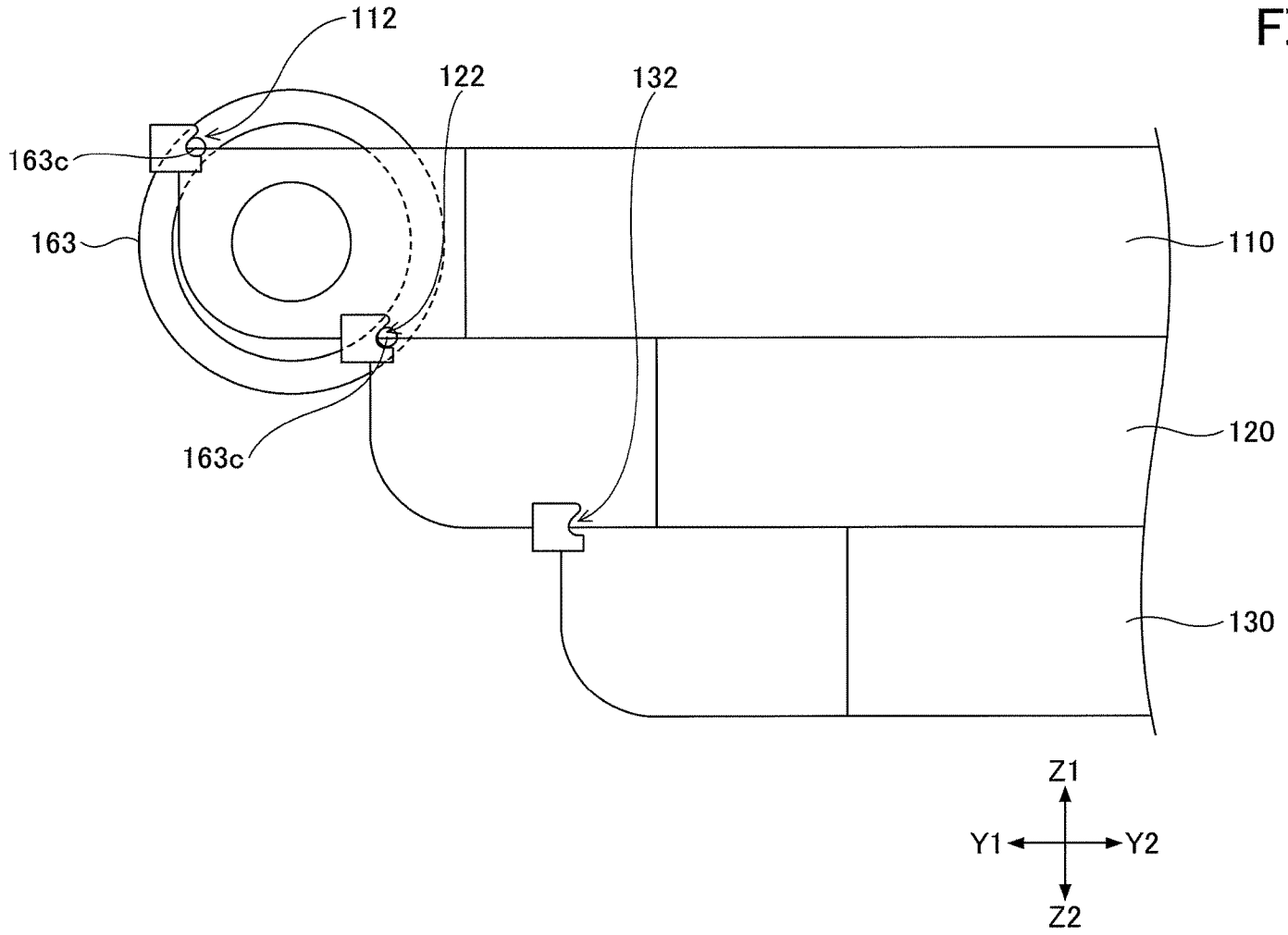

Next, the case of performing printing on a recording sheet stored in the second cassette 120 is described. FIGS. 18 through 21 illustrate that the second cassette 120 is selected. FIGS. 18, 19 and 20 are a side view, a Y2-end enlarged side view, and a Y1-end enlarged side view, respectively, of the stacked cassettes 110 through 130. FIG. 21 illustrates the cassettes 110 through 130 in the housing 101 at the time when the second cassette 120 is selected, with one of the springs 170 and one of the connecting member 171 being depicted.

Figure 22:
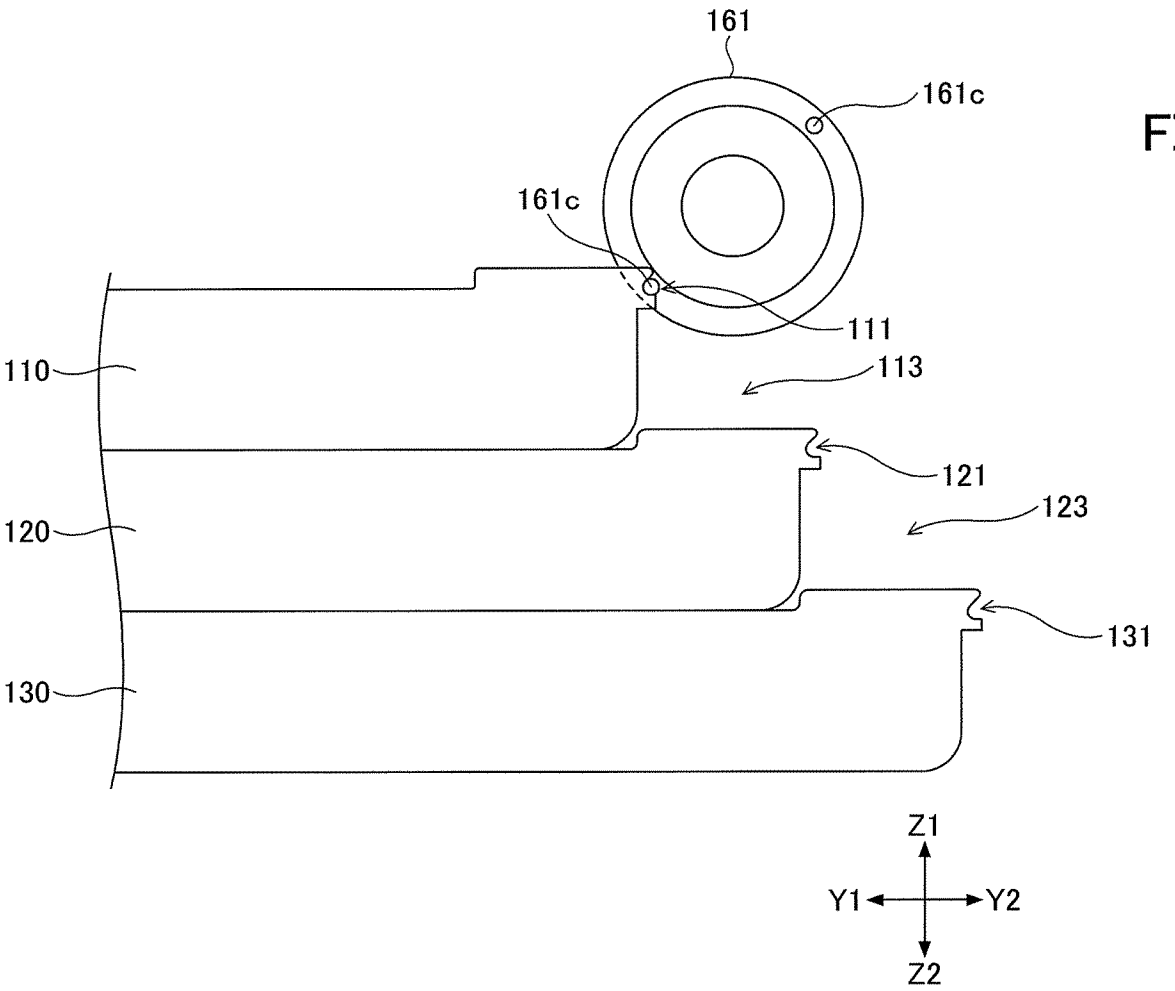
FIG. 22 is a diagram illustrating a state during the transition from the state where the first cassette is selected to the state where the second cassette is selected.

Switching from the first cassette 110 to the second cassette 120 is performed by rotating the cam 161 clockwise in FIG. 18 with the motor 168. FIG. 22 illustrates a state during the transition of switching of the cassette from the first cassette 110 to the second cassette 120. FIG. 22 illustrates the state in which the cam 161 is rotated 90° clockwise from the state illustrated in FIG. 15. By further rotating the cam 161 90° clockwise, the state illustrated in FIG. 19 occurs. Accordingly, by rotating the cam 161 180° clockwise from the state of FIG. 15, the relative positional relationship between the cam 161 and the cassettes 110 through 130 becomes as shown in the state illustrated in FIG. 19, where the first pin 161*c* is in the receiving part 111 while the second pin 161*c* is in the receiving part 121.

When switching the first cassette 110 to the second cassette 120, the receiving part 111, the receiving part 121, and the receiving part 131 move in respective paths indicated by the two-dot chain line in FIG. 19. By the rotations of the cams 161 through 164, the stacked cassettes 110 through 130 move diagonally on a straight line passing through the receiving parts 111 through 131.

When the cam 161 rotates clockwise from the state illustrated in FIG. 15 where the first cassette 110 is selected, the stacked cassettes 110 through 130 are pressed by the first pin 161*c* in the receiving part 111 to move to the lower left in their entirety. As a result, the second roller 150 contacting the recording sheet stored in the first cassette 110 relatively moves away from the recording sheet in the Z1 direction. Thereafter, when the cam 161 rotates further clockwise, the moving direction of the stacked cassettes 110 through 130 switches from the lower left to leftward, the upper left, upward, and the upper right, so that the second cassette 120 is selected as shown in FIG. 19. That is, by rotating the cam 161 180° clockwise from the state of FIG. 15 to the state of FIG. 19, the cassettes 110 through 130 move together in the Y1 direction and the Z1 direction to be in the state illustrated in FIG. 19. In response to selection of the second cassette 120, the second roller 150 moves in the Z2 direction relative to the second cassette 120 to contact the topmost recording sheet at the window 127.

When the second cassette 120 is selected, the first pin 161*c* is in the receiving part 111 and the second pin 161*c* is in the receiving part 121. Furthermore, the first pin 163*c* is in the receiving part 112 and the second pin 163*c* is in the receiving part 122. FIG. 10 illustrates this state.

In the state illustrated in FIG. 21, the support pin 128 in the elongated hole 171*a* is pressed in the Y2 direction by the spring 170. Furthermore, the second roller 150 is in contact with the topmost recording sheet in the second cassette 120.

Figure 23:
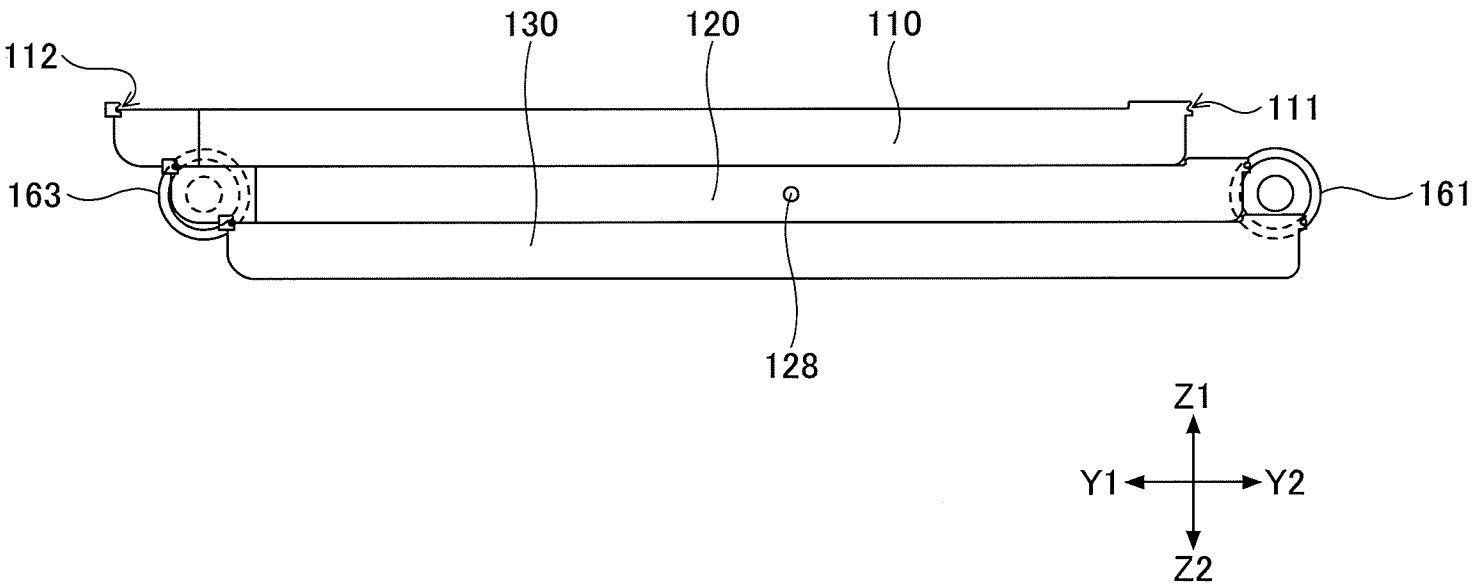
FIGS. 23 through 26 are diagrams illustrating that the third cassette is selected.
Figure 24:
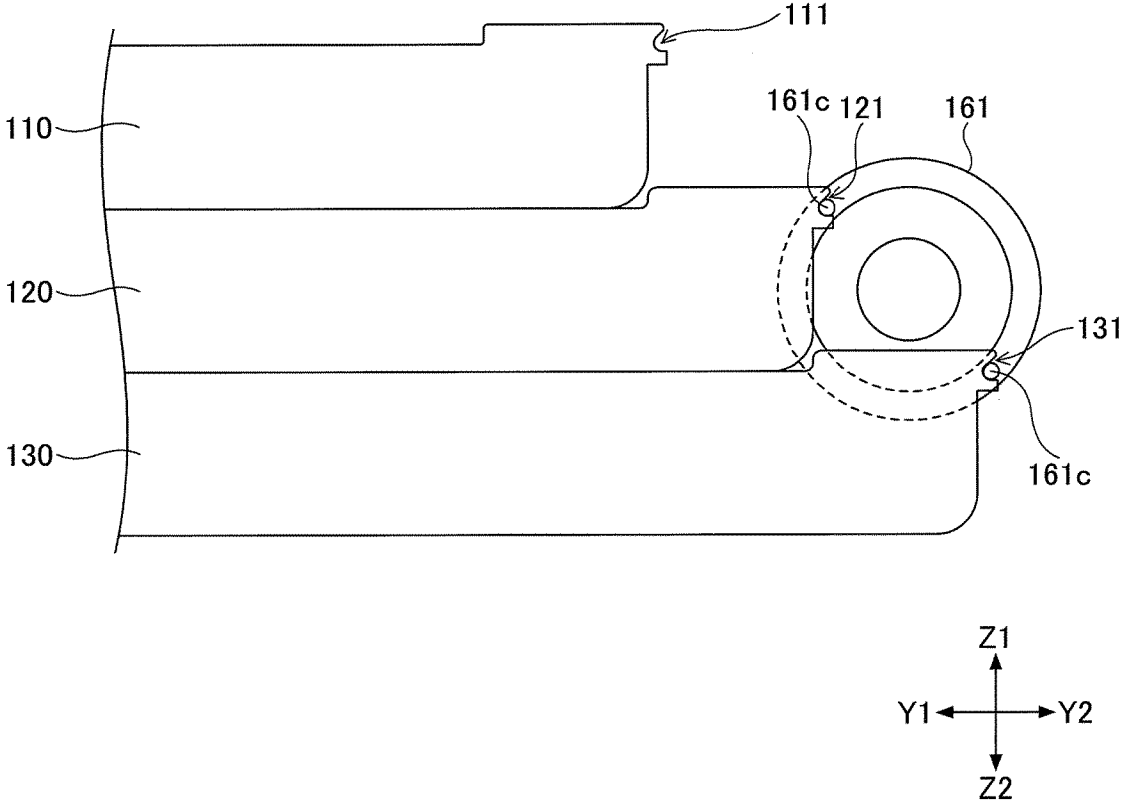
Figure 25:
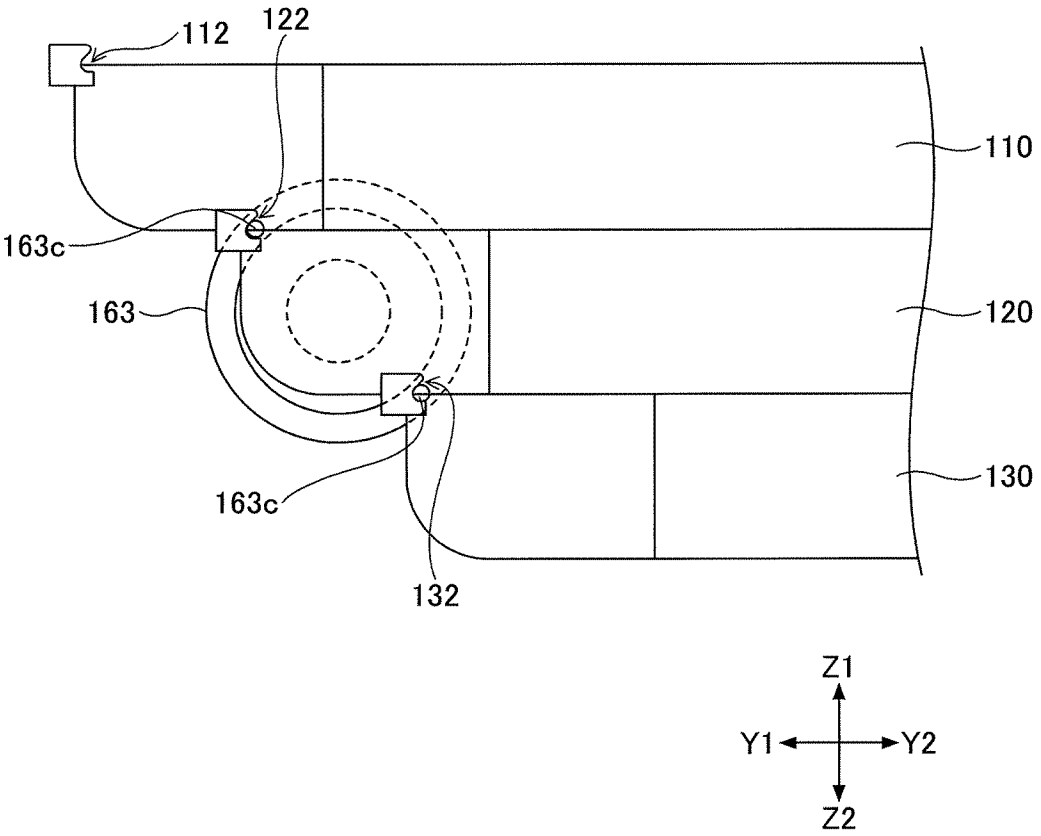

Next, the case of performing printing on a recording sheet stored in the third cassette 130 is described. FIGS. 23 through 26 illustrate the state that the third cassette 130 is selected. FIGS. 23, 24 and 25 are a side view, a Y2-end enlarged side view, and a Y1-end enlarged side view, respectively, of the stacked cassettes 110 through 130.

Like switching the cassette from the first cassette 110 to the second cassette 120, the transition from the state of FIG. 19 where the second cassette 120 is selected to the state of FIG. 24 where the third cassette 130 is selected is performed by rotating the cam 161 180° clockwise by the motor 168.

In the state of FIG. 24 where the third cassette 130 is selected, the first pin 161*c* is in the receiving part 131 and the second pin 161*c* is in the receiving part 121. Furthermore, as illustrated in FIG. 25, the first pin 163*c* is in the receiving part 132 and the second pin 163*c* is in the receiving part 122.

As a result, the stacked cassettes 110 through 130 move to the upper left from the state illustrated in FIG. 21 to the position illustrated in FIG. 26, so that the second roller 150 contacts the topmost recording sheet stored in the third cassette 130. Furthermore, in the state illustrated in FIG. 26, the support pin 128 is pressed in the Y2 direction by the spring 170.

As described above, by moving the cassettes 110 through 130 using the cams 161 through 164, a recording sheet to be subjected to printing is selected. Therefore, there is no need to carry around multiple types of sheet cassettes, thus leading to more convenience.

The cassette is switched from the first cassette 110 to the second cassette 120 or from the second cassette 120 to the third cassette 130 as described above, while the cassette is switched from the third cassette 130 to the second cassette 120 or from the second cassette 120 to the first cassette 110 by rotating the cam 161 counterclockwise.

Furthermore, according to this embodiment, the first cassette 110, the second cassette 120, and the third cassette 130 may be provided with respective marks for their identification. By detecting these marks at a detecting part, the type of a recording sheet or a selected cassette can be automatically determined, and by moving the position of the cassettes by rotating the cam 161, a desired recording sheet is selected.

Figure 27:
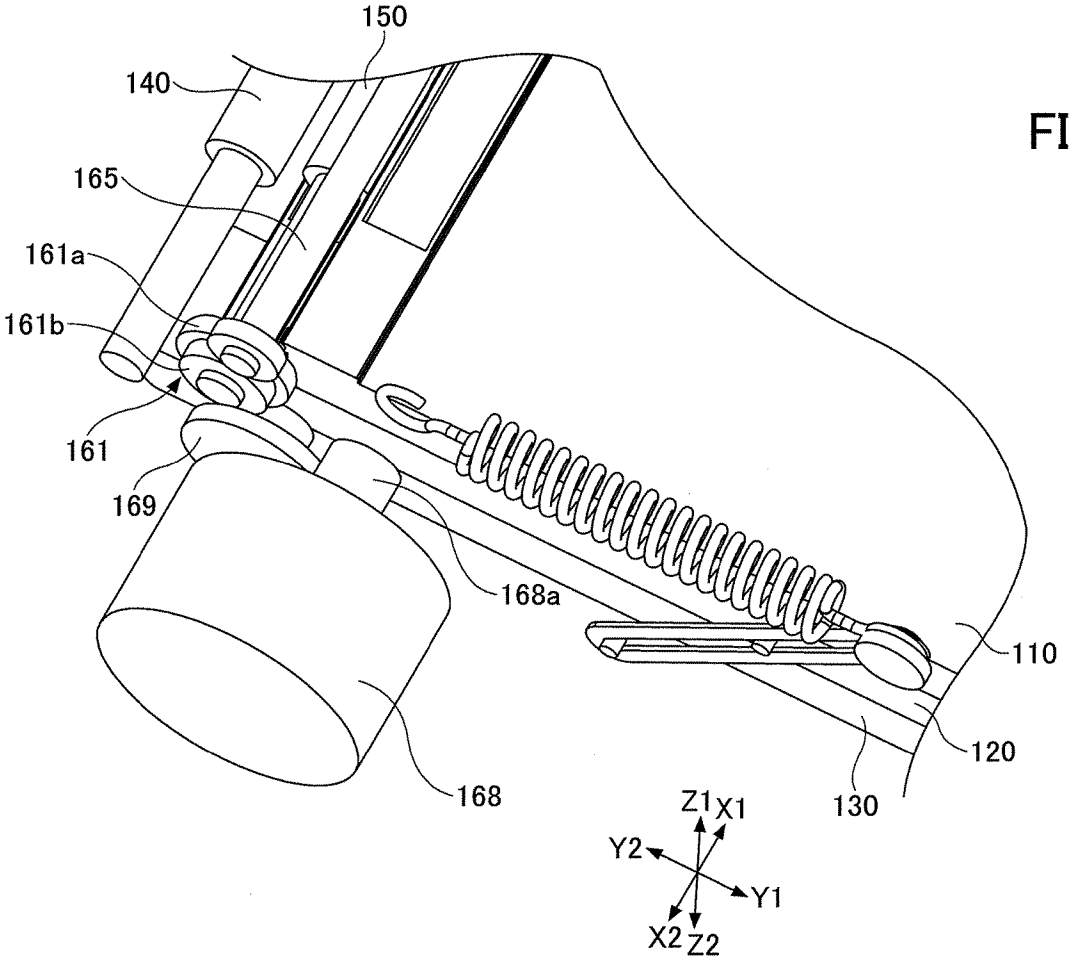
FIG. 27 is a diagram illustrating a method of driving a rotary transfer cam.

According to this embodiment, the motor 168 may be directly coupled to the cam 161 or, as illustrated in FIG. 27, a transmitting member 169 such as a gear may be provided between a rotating shaft 168*a* of the motor 168 and the cam 161. In the latter case, by rotating the motor 168, it is possible to rotate the transmitting member 169 contacting the rotating shaft 168*a* to rotate the cam 161 contacting the transmitting member 169.

Figure 28:
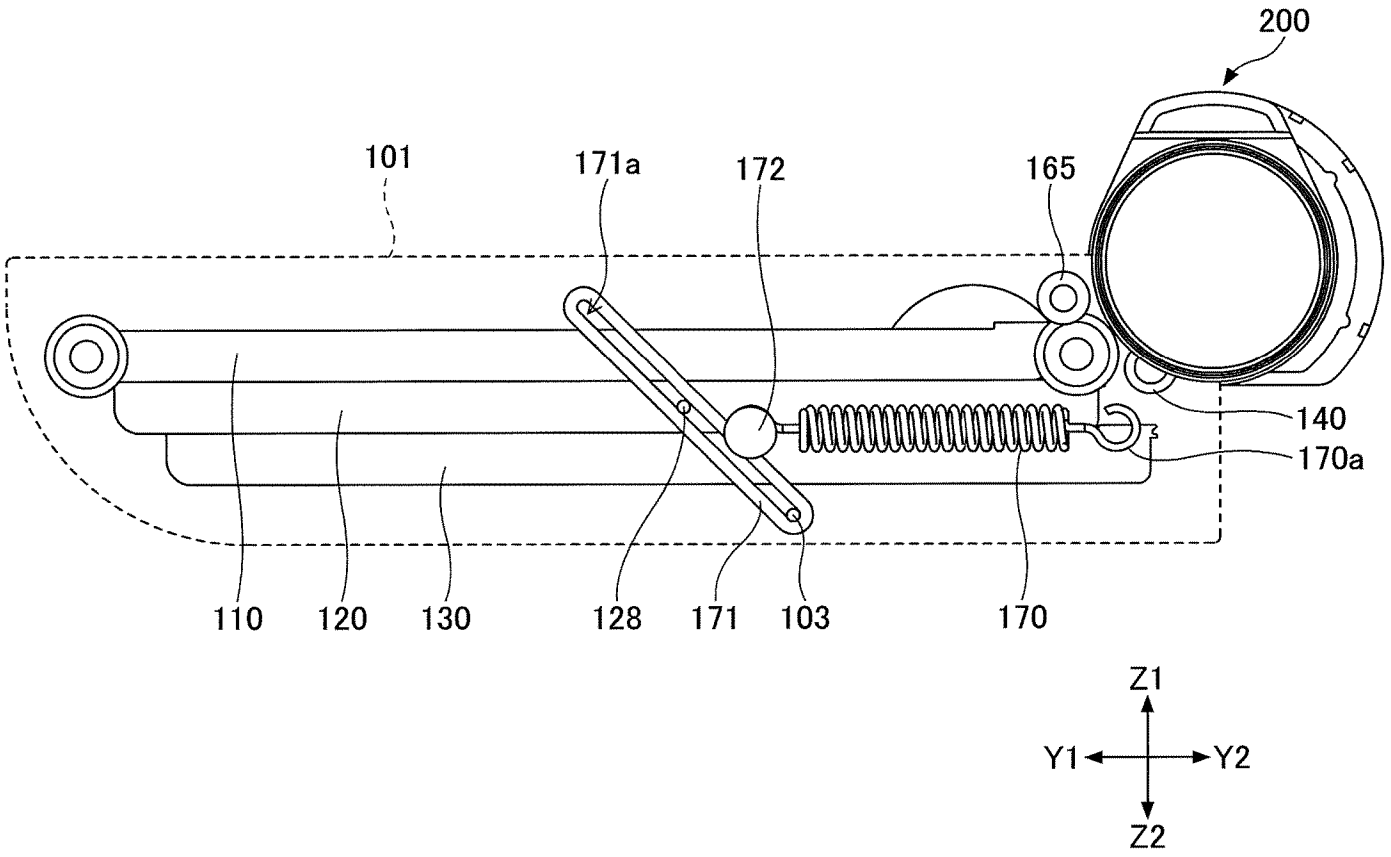
FIG. 28 is a diagram illustrating a connection of the sheet cassette and the printer.
Figure 29:
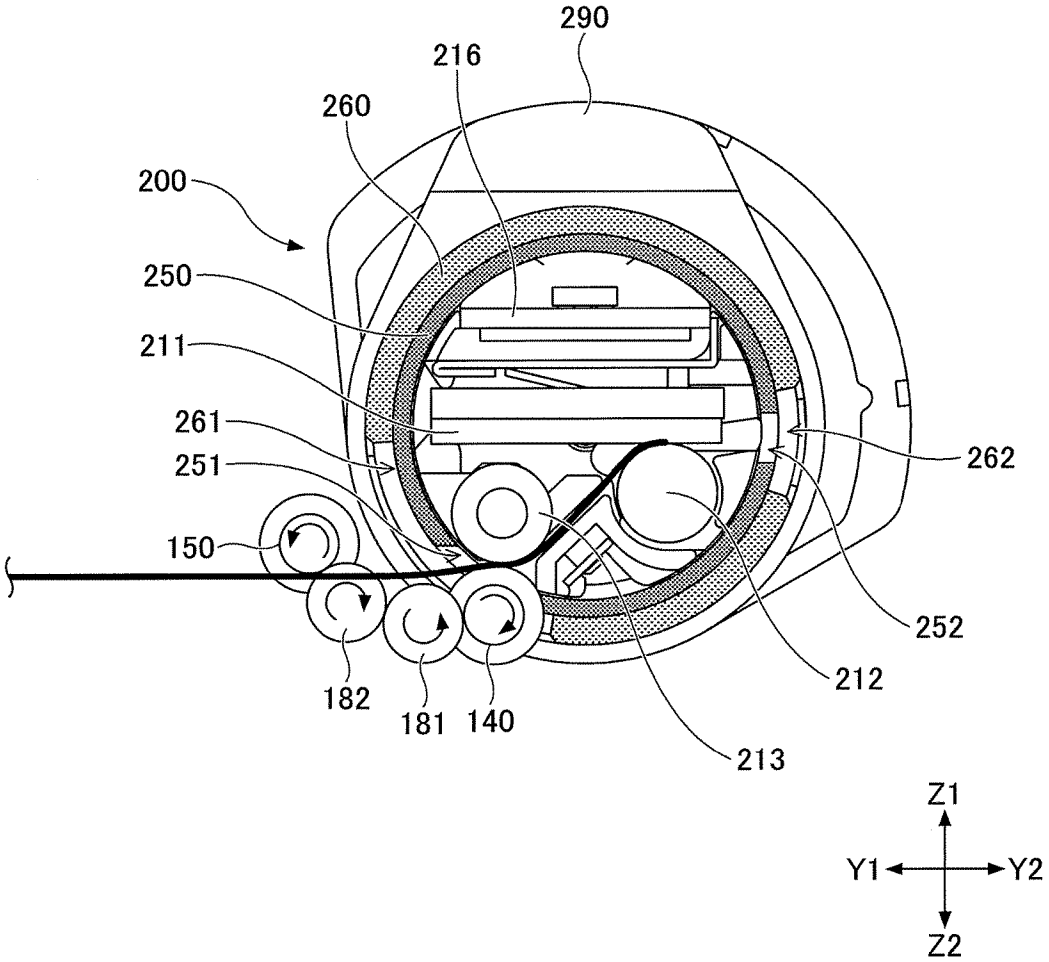
FIG. 29 is a diagram illustrating a printing method according to the first embodiment.

Next, printing in the printing apparatus is described. FIG. 28 illustrates the printer 200 and the sheet cassette 100 where the second cassette 120 is selected. FIG. 29 is an enlarged cross-sectional view of the printer 200, illustrating its connection to the second cassette 120.

When the opening 102 is connected to the openings 251 and 261, the feed roller 213 contacts the first roller 140. The first roller 140 is rotated by the rotation of the feed roller 213. The sheet cassette 100 includes a first gear 181 and a second gear 182 that rotate the second roller 150 with the rotation of the first roller 140. The first gear 181 is connected to a gear directly coupled to the first roller 140. The second gear 182 is connected to the first gear 181. A gear directly coupled to the second roller 150 is connected to the second gear 182. In FIG. 29, the depiction of the teeth of the first and second gears 181 and 182 is omitted for clarification. The depiction of the first and second gears 181 and 182 is omitted in the drawings other than FIG. 29.

When performing printing with the printer 200, the feed roller 213 rotates counterclockwise in FIG. 29 to convey a recording sheet toward the print head 211. When the feed roller 213 rotates counterclockwise, the first roller 140 rotates clockwise, and this rotation is transmitted to the second roller 150 via the first gear 181 and the second gear 182 to rotate the second roller 150 counterclockwise.

In the state illustrated in FIG. 10, the second roller 150 contacts the topmost recording sheet stored in the second cassette 120 through the window 127. With the counterclockwise rotation of the second roller 150, the recording sheet moves in the Y2 direction to be conveyed toward the printer 200. The recording sheet passes through the opening 102 connected to the openings 251 and 261 to be conveyed toward the print head 211, being held between the feed roller 213 and the first roller 140. The first roller 140 and the second roller 150 have a one-way clutch function and the recording sheet is not sent toward the sheet cassette 100 when the feed roller 213 rotates clockwise.

To perform printing in the printing apparatus, the touch-screen of the information terminal is operated to input instructions for printing to the information terminal. As a result, print information stored in a memory of the information terminal and a print command signal are transmitted to the printing apparatus by communications using, for example, BLE, and printing is performed based on this information.

Figure 30:
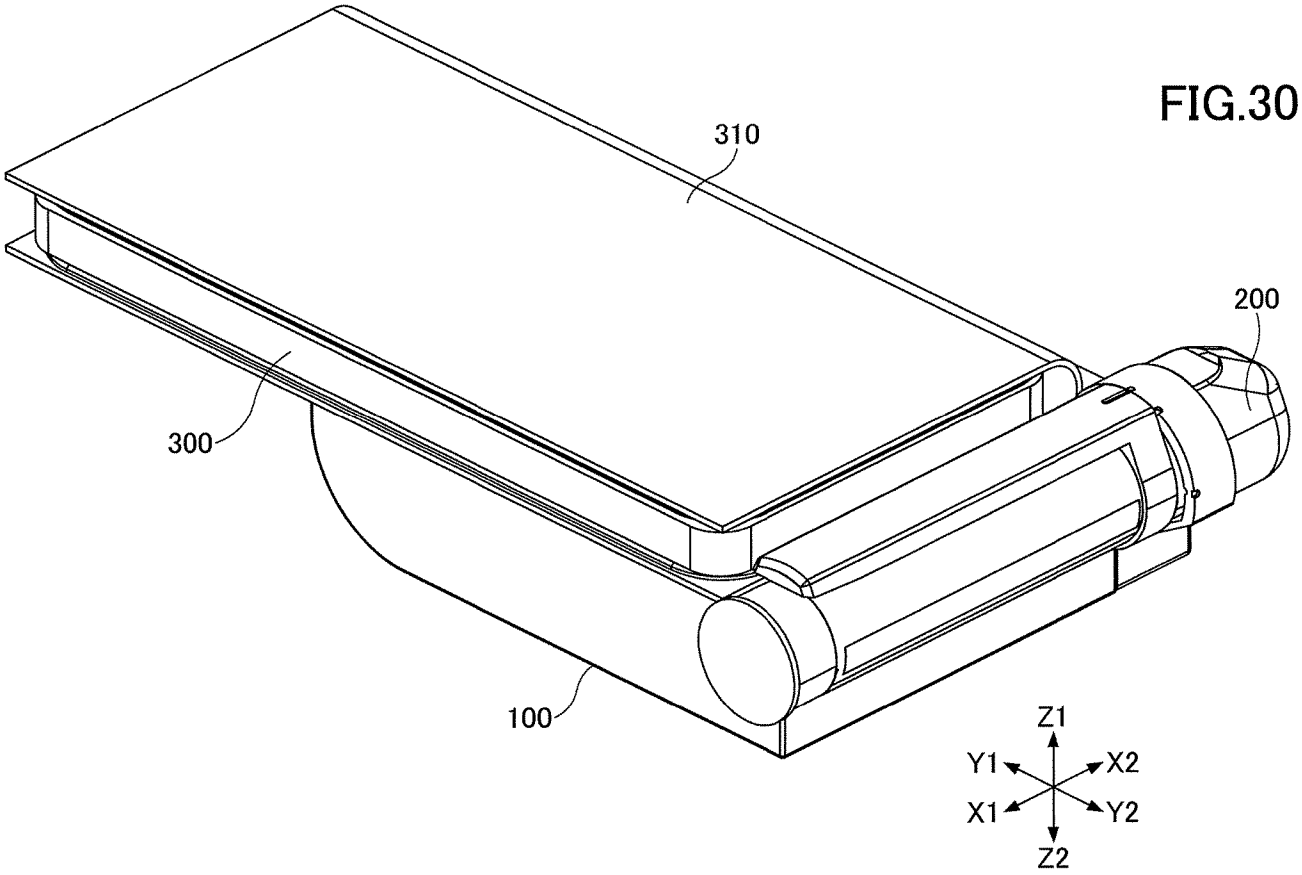
FIG. 30 is a perspective view of a variation of the printing apparatus according to the first embodiment.

Another connection example according to the printing apparatus is described. FIG. 30 illustrates the printer 200 to which the sheet cassette 100 is connected being attached to an information terminal 300. In this case, the power supply 280 is removed from the printer 200. A smartphone jacket 310 is attached to the information terminal 300. The smartphone jacket 310 is connected to the printer 200 or the sheet cassette 100 by a connecting member.

Second Embodiment

Figure 31:
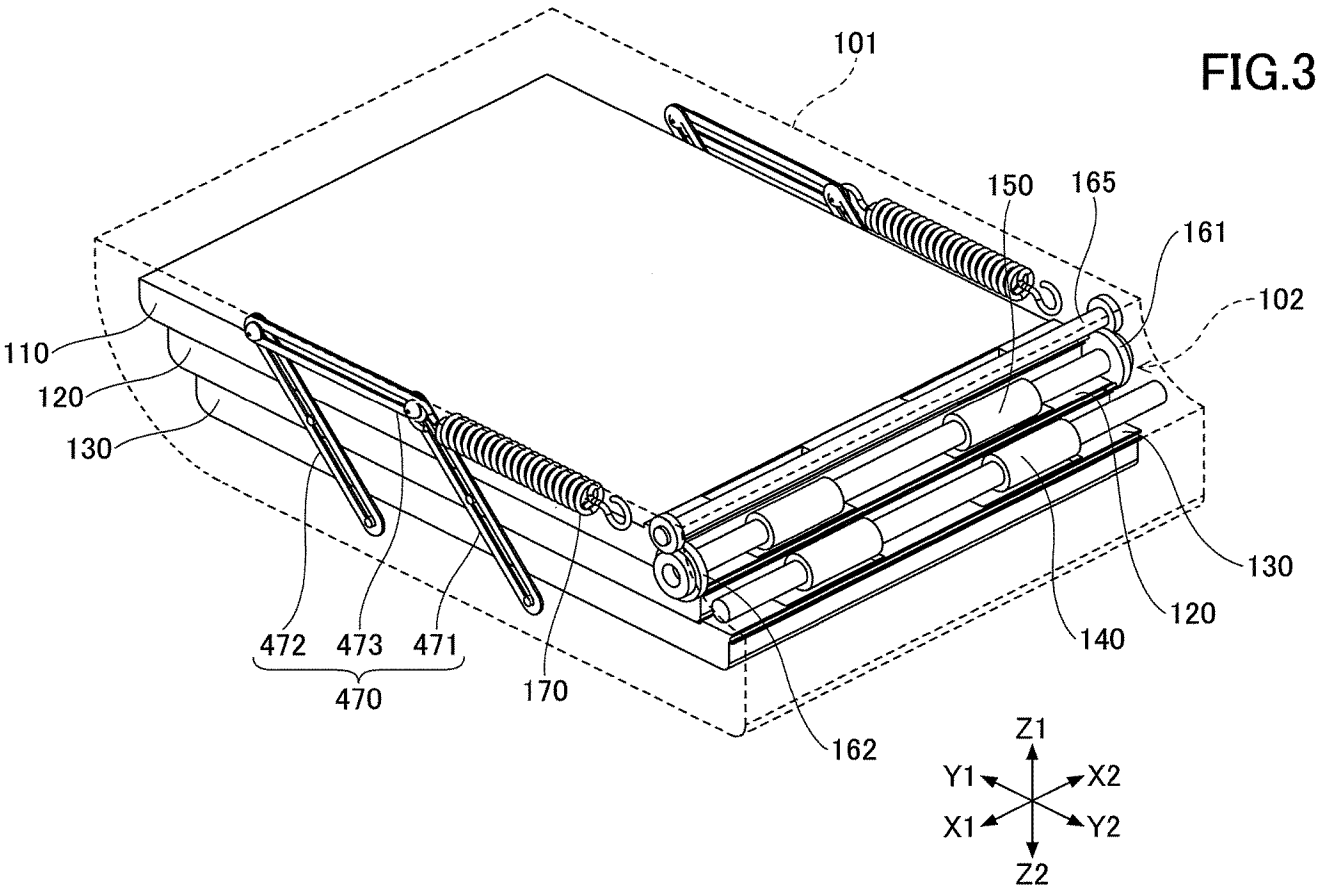
FIG. 31 is a perspective view of the inside of the sheet cassette according to a second embodiment.
Figure 32:
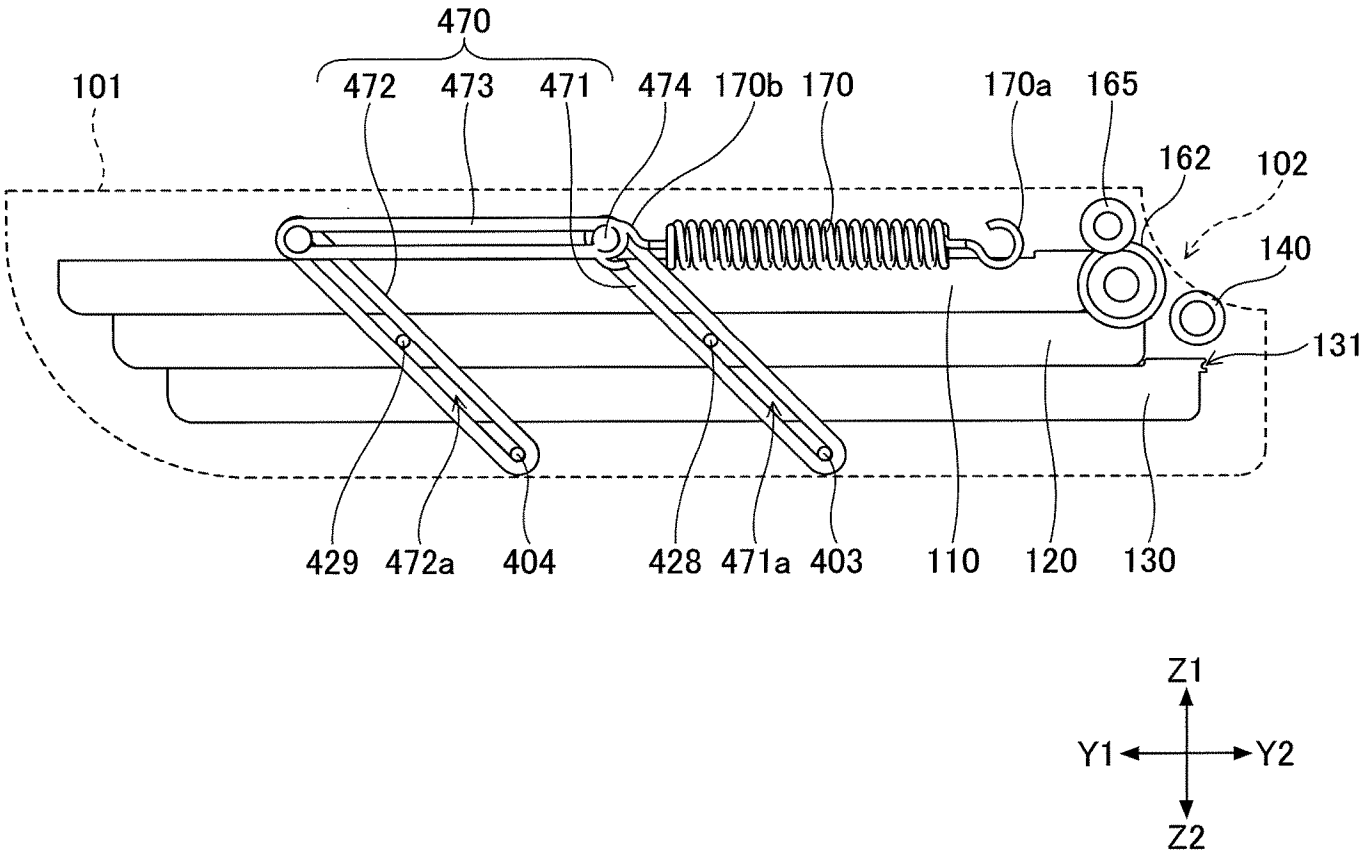
FIG. 32 is a left side view of the inside of the sheet cassette according to a second embodiment.

Next, the sheet cassette 100 according to a second embodiment is described. FIGS. 31 and 32 are a perspective phantom view and a left side view, respectively, of the sheet cassette 100 according to this embodiment.

According to this embodiment, the cassettes 110 through 130 and the first and second rollers 140 and 150 are provided in the housing 101 of the sheet cassette 100.

The sheet cassette 100 includes the cams 161 and 162 and the transmission shaft 165, but does not include the cams 163 and 164 and the timing belts 166 and 167. In FIGS. 31 through 38, the depiction of the motor 168 is omitted.

Referring to FIG. 32, two support pins 428 and 429 are provided on each of the X1-side surface and the X2-side surface of the second cassette 120. Furthermore, the springs 170 are provided one on each of the X1 side and the X2 side and connecting members 470 are provided one on each of the X1 side and the X2 side of the cassettes 110 through 130. Each connecting member 470 includes a first connecting member 471, a second connecting member 472, and a coupling member 473. By providing the first connecting member 471 and the second connecting member 472, it is possible to move the cassettes 110 through 130 while keeping the cassettes 110 through 130 in parallel. Therefore, the cams 163 and 164 and the timing belts 166 and 167 provided in the first embodiment are dispensed with.

The springs 170 are, for example, coil springs, and have their respective first ends 170*a* connected to the inside of the housing 101 and their respective second ends 170*b* connected to connection parts 474 provided one on each connecting member 470. In each connecting member 470, the first connecting member 471 and the second connecting member 472 have substantially the same shape, and an elongated hole 471*a* and an elongated hole 472*a* are formed in the first connecting member 471 and the second connecting member 472, respectively. The Z1-side ends of the first connecting member 471 and the second connecting member 472 are connected by the coupling member 473. With the first connecting member 471 and the second connecting member 472 being connected by the coupling member 473, the longitudinal direction of the elongated hole 471*a* is parallel to the longitudinal direction of the elongated hole 472*a*. Accordingly, each connecting member 470 including the first connecting member 471, the second connecting member 472, and the coupling member 473 is like a pantograph.

The support pin 428 provided on each side of the second cassette 120 and a support pin 403 provided on the inside of the housing 101 are in each elongated hole 471*a*. Likewise, the support pin 429 and a support pin 404 are in each elongated hole 472*a*. In this state, a restoring force is exerted on each spring 170 in a compressing direction, namely, in a direction to move each connecting member 470 in the Y2 direction.

According to this embodiment, the receiving part 111 is provided at the Y2-side upper end of the first cassette 110. The receiving part 121 is provided at the Y2-side upper end of the second cassette 120. The receiving part 131 is provided at the Y2-side upper end of the third cassette 130. No receiving part may be provided at the Y1-side upper end of each of the cassettes 110 through 130.

Next, selecting a recording sheet in the sheet cassette 100 is described.

Figure 33:
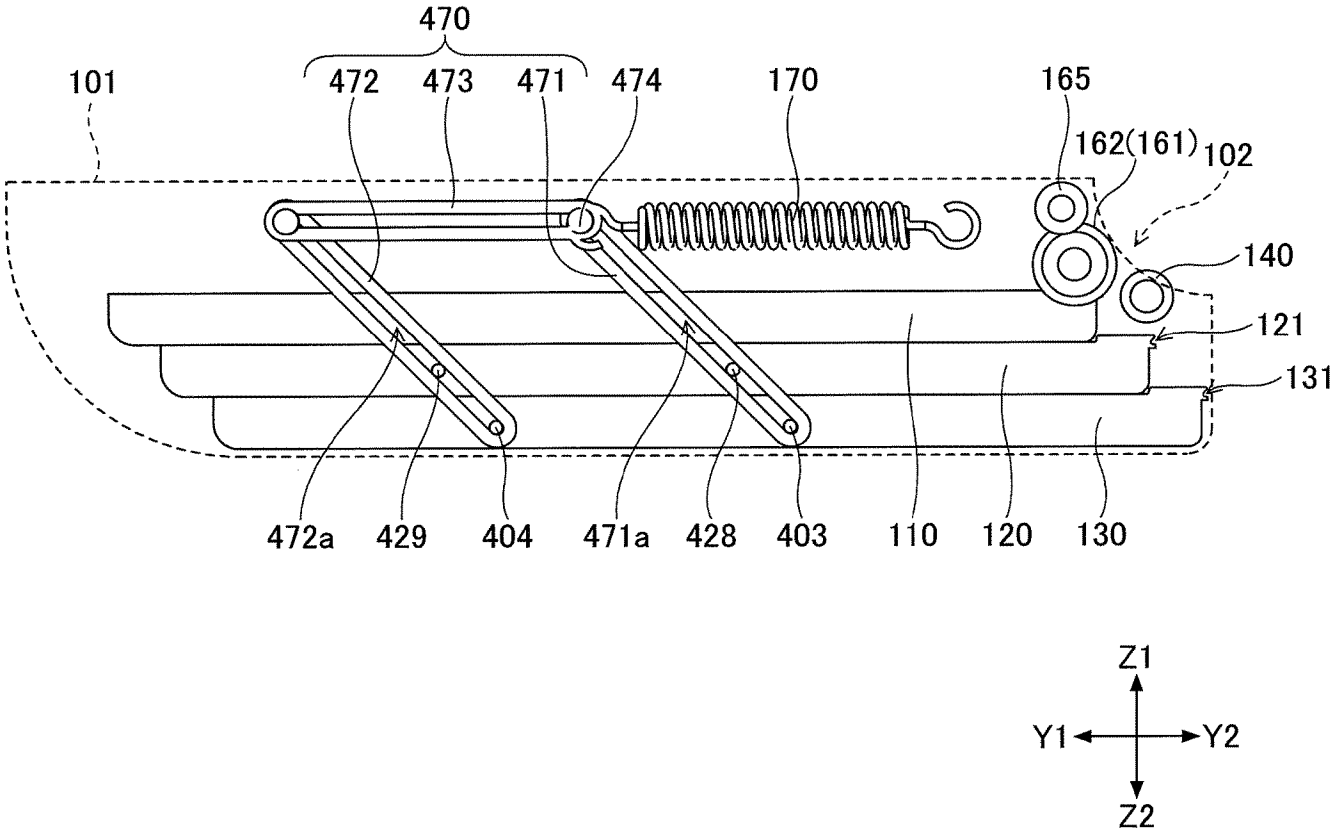
FIG. 33 is a diagram illustrating that the first cassette is selected.

Printing on a recording sheet stored in the first cassette 110 is described with reference to FIG. 33. In FIGS. 33 through 36, while the cam 162 is depicted for convenience, the cam 161 is provided at a corresponding position on the other side of the illustrated structure.

Although not depicted, when the first cassette 110 is selected, the first pin 161*c* is in the receiving part 111, and the second pin 161*c* is in contact with nothing.

In this state, an urging force is exerted on the first connecting member 471 in the clockwise direction in FIG. 33 around the support pin 403 by the spring 170, and an urging force is exerted on the second connecting member 472 in the clockwise direction in FIG. 33 around the support pin 404 by the spring 170. The support pin 428 in the elongated hole 471*a* and the support pin 429 in the elongated hole 472*a* are pressed in the Y2 direction by these urging forces.

Next, the case of performing printing on a recording sheet stored in the second cassette 120 is described with reference to FIG. 34.

Figure 34:
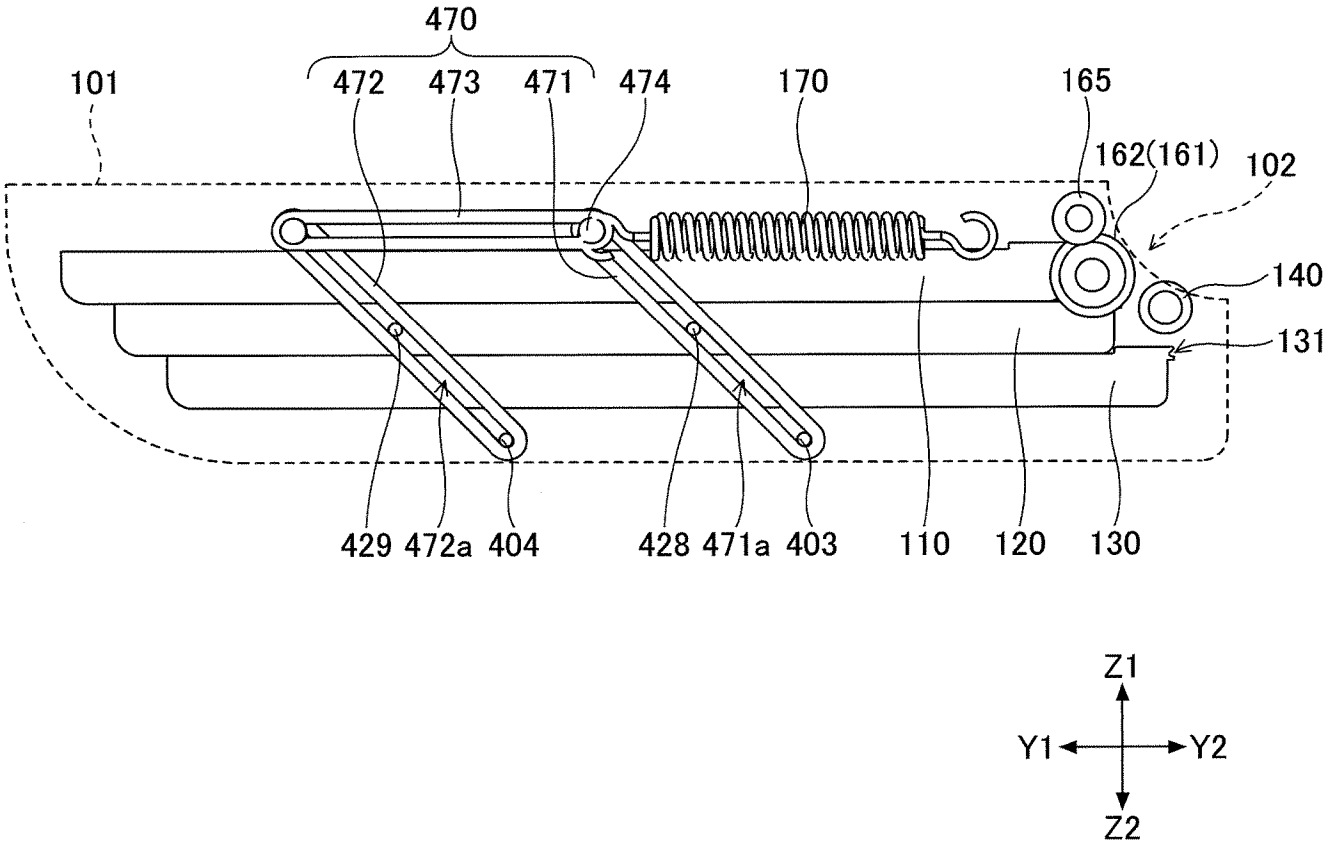
FIG. 34 is a diagram illustrating that the second cassette is selected.
Figure 35:
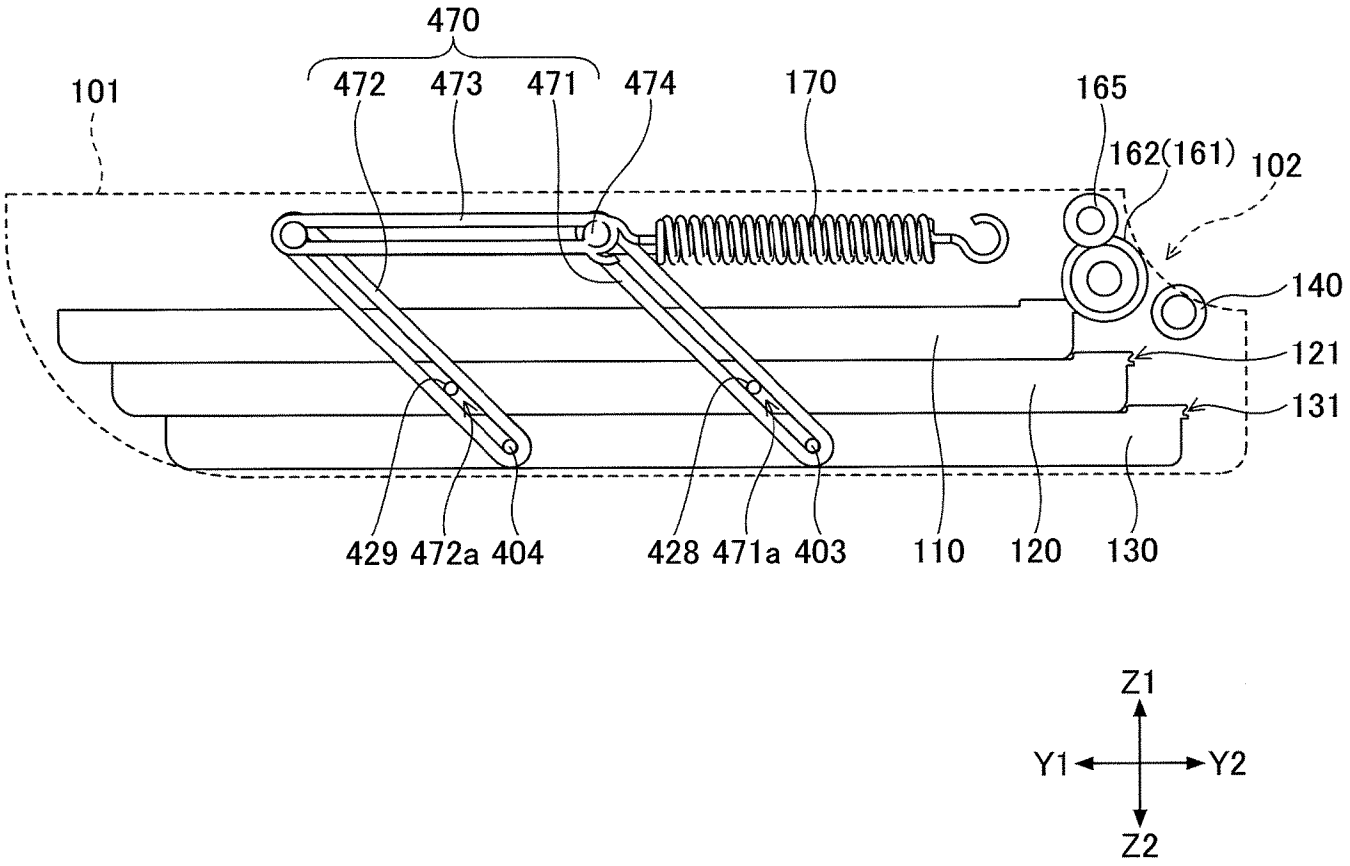
FIG. 35 is a diagram illustrating a state during the transition from the state where the first cassette is selected to the state where the second cassette is selected.

Changing the cassette from the first cassette 110 to the second cassette 120 is performed by rotating the cam 161 in the clockwise direction in FIG. 34 with the motor 168. FIG. 35 illustrates a state during the transition from the state where the first cassette 110 is selected to the state where the second cassette 120 is selected. In FIG. 35, the cam 161 is rotated 90° clockwise from the state illustrated in FIG. 33. In FIG. 34, the cam 161 is further rotated 90° clockwise. That is, by rotating the cam 161 180° clockwise from the state of FIG. 33, the stacked cassettes 110 through 130 move to the upper left as shown in FIG. 34.

Although not depicted, when the second cassette 120 is selected, the first pin 161*c* is in the receiving part 111, and the second pin 161*c* is in the receiving part 121. Furthermore, in the state illustrated in FIG. 34, the support pin 428 and the support pin 429 are pressed in the Y2 direction by the spring 170.

Figure 36:
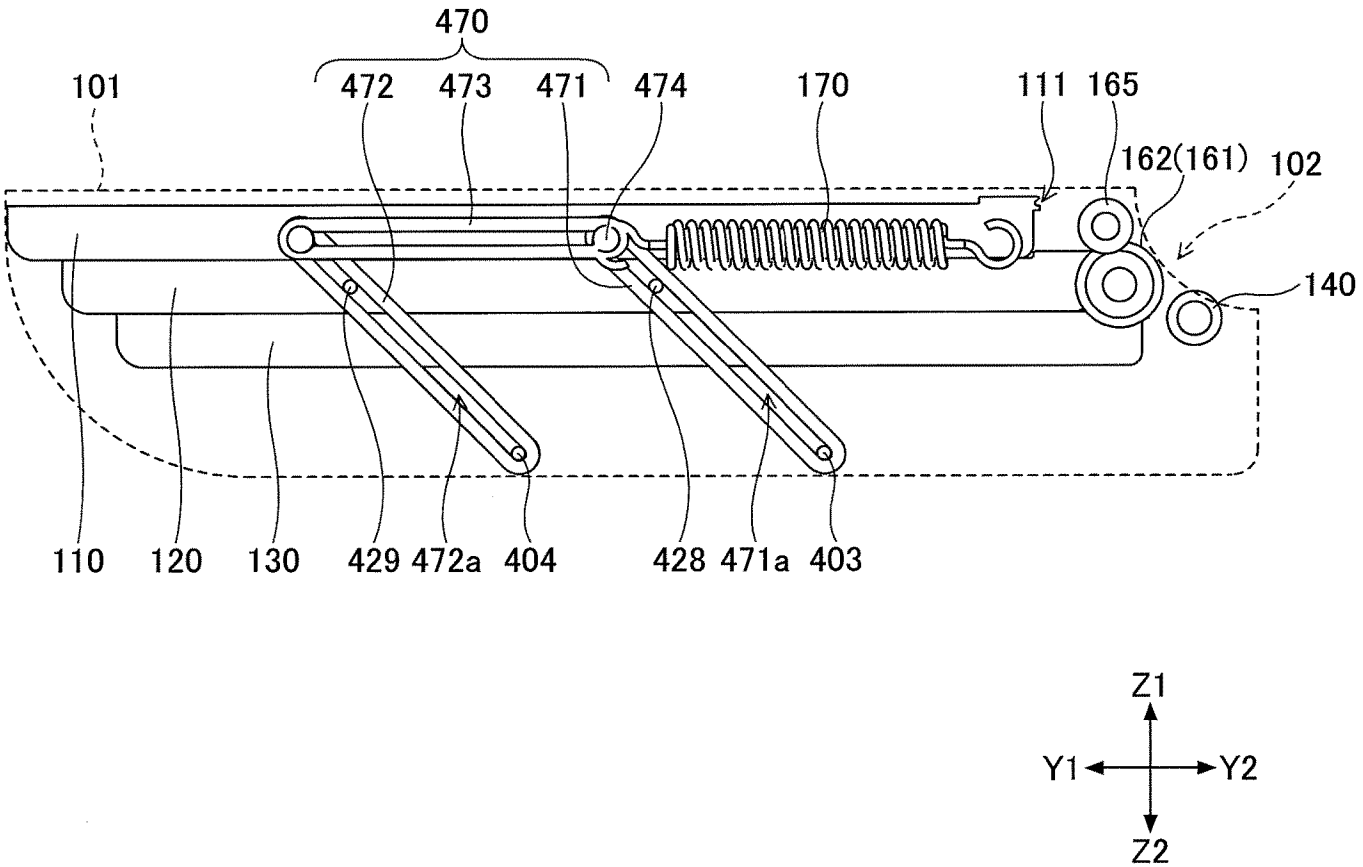
FIG. 36 is a diagram illustrating that the third cassette is selected.

Next, the case of performing printing on a recording sheet stored in the third cassette 130 is described with reference to FIG. 36.

When changing the cassette from the second cassette 120 to the third cassette 130, the cam 161 is rotated 180° clockwise by the motor 168. By this operation, the stacked cassettes 110 through 130 move to the upper left in the drawings from the position of FIG. 34 to the position of FIG. 36, so that the second roller 150 contacts the recording sheet stored in the third cassette 130.

Although not depicted, when the third cassette 130 is selected, the first pin 161*c* is in the receiving part 131, and the second pin 161*c* is in the receiving part 121. Furthermore, in the state illustrated in FIG. 36, the support pin 428 and the support pin 429 are pressed in the Y2 direction by the spring 170.

Figure 37:
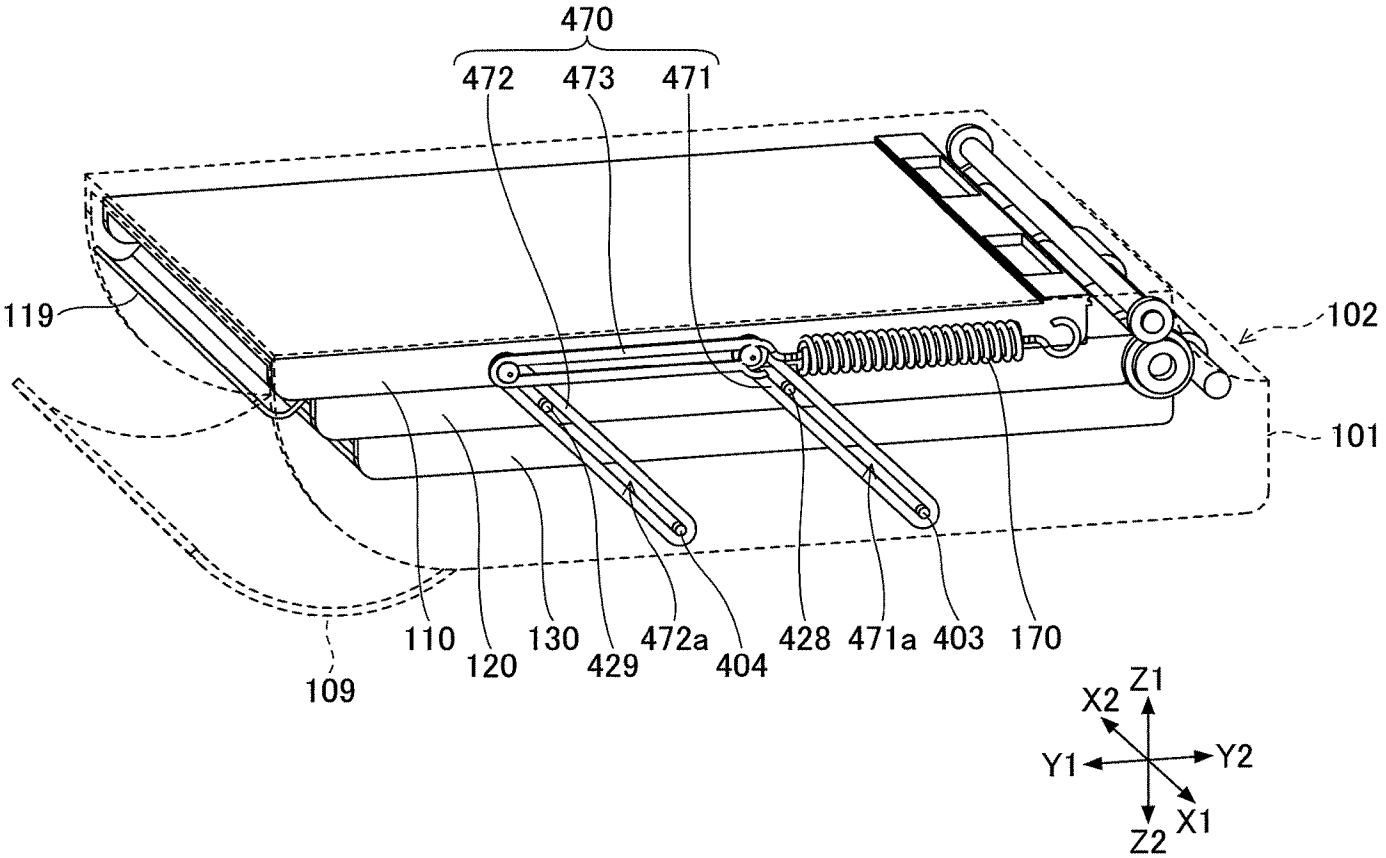
FIGS. 37 and 38 are diagrams illustrating rear lids of the sheet cassette according to the second embodiment.
Figure 38:
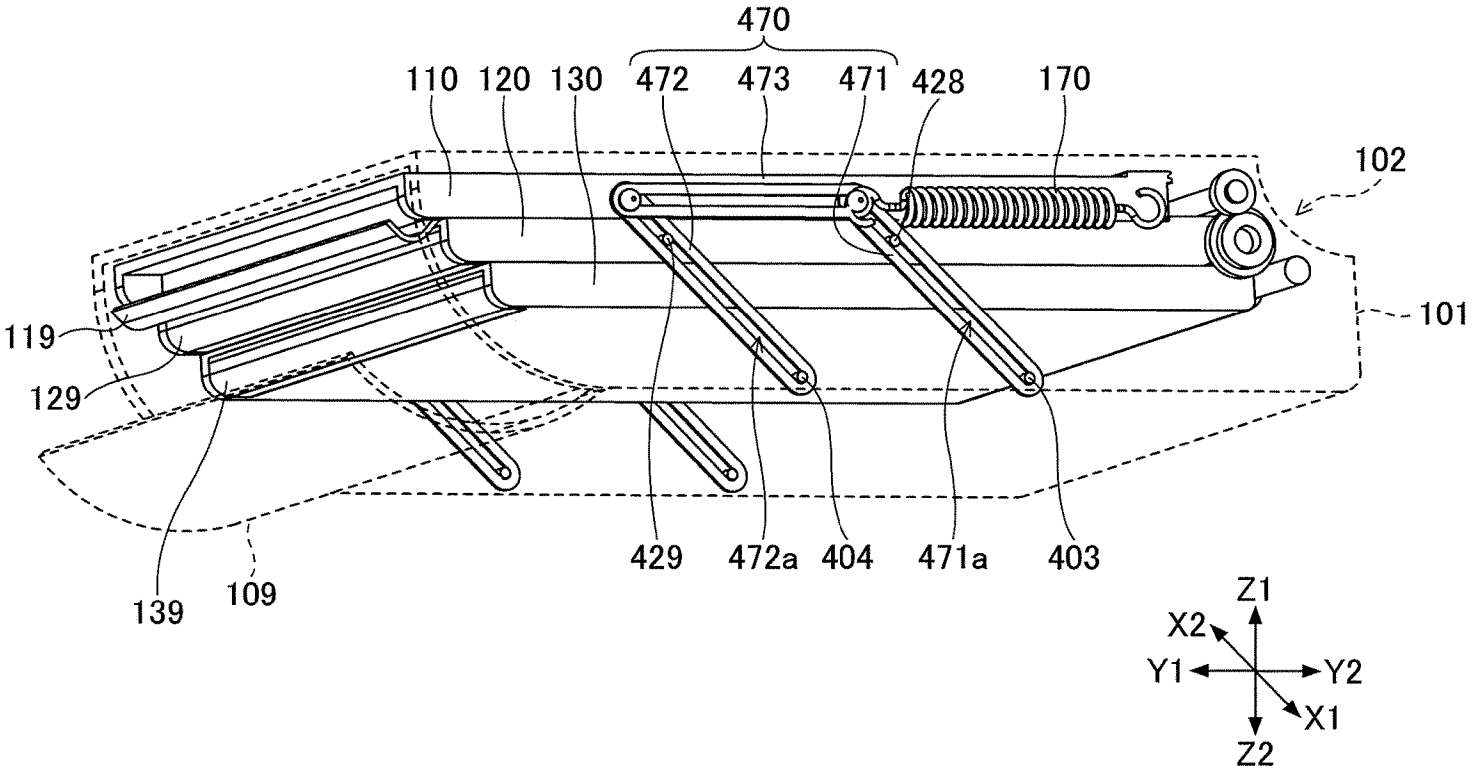

According to the sheet cassette 100 of this embodiment, as illustrated in FIGS. 37 and 38, a rear lid 109 is provided in the housing 101 near its Y1-side end, and a rear lid 119 is provided in the first cassette 110 near its Y1-side end. To load recording sheets into the first cassette 110, the rear lid 109 and the rear lid 119 are opened.

Likewise, a rear lid 129 is provided in the second cassette 120 near its Y1-side end. To load recording sheets into the second cassette 120, the rear lid 109 and the rear lid 129 are opened.

Furthermore, a rear lid 139 is provided in the third cassette 130 near its Y1-side end. To load recording sheets into the third cassette 130, the rear lid 109 and the rear lid 139 are opened. By thus providing the rear lids 109, 119, 129 and 139, recording sheets can be loaded into the sheet cassette 100 while the sheet cassette 100 remains connected to the printer 200.

The rear lids 109, 119, 129 and 139 may also be applied to the first embodiment. In other respects than those described above, the second embodiment may be the same as the first embodiment.

All examples and conditional language provided herein are intended for pedagogical purposes of aiding the reader in understanding the invention and the concepts contributed by the inventors to further the art, and are not to be construed as limitations to such specifically recited examples and conditions, nor does the organization of such examples in the specification relate to a showing of the superiority or inferiority of the invention. Although one or more embodiments of the present invention have been described in detail, it should be understood that the various changes, substitutions, and alterations could be made hereto without departing from the spirit and scope of the invention. For example, the number of cassettes is not limited to three, and may be two or four or more.

What is claimed is:

1. A sheet cassette comprising:

a housing;

a plurality of cassettes configured to store a recording sheet, the cassettes being stacked and provided in the housing; and a rotary cam including a plurality of pins provided at opposite positions across an axis of rotation of the rotary cam, wherein adjacent cassettes are offset relative to each other in an offset direction, wherein first receiving parts for receiving the pins are provided one in each of the adjacent cassettes at a first end thereof in the offset direction, and the rotary cam is configured to rotate with at least one of the pins being in at least one of the first receiving parts of the adjacent cassettes to move the cassettes as connected.

2. The sheet cassette as claimed in claim 1, further comprising:

a roller configured to feed the recording sheet from the cassettes, wherein the rotary cam is concentrically provided on a shaft of the roller.

3. The sheet cassette as claimed in claim 1, further comprising:

another rotary cam including a plurality of other pins provided at opposite positions across an axis of rotation of said another rotary cam, wherein second receiving parts for receiving the other pins are provided one in each of the adjacent cassettes at a second end thereof, the second end being opposite to the first end in the offset direction, the rotary cam and said another rotary cam are provided on a first-end side and a second-end side, respectively, of the adjacent cassettes, and said another rotary cam is configured to rotate with at least one of the other pins being in at least one of the second receiving parts of the adjacent cassettes to move the cassettes as connected.

4. The sheet cassette as claimed in claim 3, further comprising:

a spring connected to the housing;

a connecting member having an elongated hole, the connecting member being connected to the spring;

a first support pin provided on a side of at least one of the cassettes; and a second support pin provided on the housing, wherein the first support pin and the second support pin are in the elongated hole, and the cassettes are pressed in a direction of the first end via the connecting member, the first support pin, and the second support pin by the spring.

5. The sheet cassette as claimed in claim 1, further comprising:

a plurality of connecting members having respective elongated holes;

a coupling member connecting the connecting members;

a spring having a first end connected to the housing and a second end connected to the elongated holes;

a plurality of first support pins provided on a side of at least one of the cassettes; and a plurality of second support pins provided on the housing, wherein one of the first support pins and one of the second support pins are in one of the elongated holes, and another one of the first support pins and another one of the second support pins are in another one of the elongated holes, and the cassettes are pressed in a direction of the first end of the adjacent cassettes via the connecting members, the first support pins, and the second support pins by the spring.

6. A printing apparatus comprising:

the sheet cassette as set forth in claim 1; and a printer connected to the sheet cassette and configured to perform printing on the recording sheet fed from the sheet cassette.

* * * * *